US011852321B2

(12) United States Patent
Lang et al.

(10) Patent No.: US 11,852,321 B2
(45) Date of Patent: Dec. 26, 2023

(54) MOVEABLE LENS LUMINAIRE

(71) Applicant: Schreder S.A., Brussels (BE)

(72) Inventors: Vincent Lang, Grâce-Hollogne (BE); Michel Delvaux, Henri-Chapelle (BE); Roxane Caprara, Neuprè (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/663,964

(22) Filed: May 18, 2022

(65) Prior Publication Data

US 2022/0299191 A1 Sep. 22, 2022

Related U.S. Application Data

(63) Continuation of application No. 16/960,295, filed as application No. PCT/EP2018/086842 on Dec. 24, 2018, now Pat. No. 11,353,195.

(30) Foreign Application Priority Data

Jan. 5, 2018 (BE) ..... 2018/5004

(51) Int. Cl.
*F21V 17/02* (2006.01)
*F21V 14/04* (2006.01)
*F21V 14/06* (2006.01)

(52) U.S. Cl.
CPC ..... *F21V 17/02* (2013.01); *F21V 14/04* (2013.01); *F21V 14/06* (2013.01)

(58) Field of Classification Search
CPC .... F21V 11/04; F21V 11/186; F21V 23/0442; F21V 23/045; F21V 23/0435;
(Continued)

(56) References Cited

U.S. PATENT DOCUMENTS 5,097,354 A 3/1992 Goto
5,775,799 A 7/1998 Forkner
(Continued)

FOREIGN PATENT DOCUMENTS

DE 102011100279 A1 10/2012
EP 2503231 A2 * 9/2012 ..... F21V 14/06
(Continued)

OTHER PUBLICATIONS

PCT International Search Report and Written Opinion, PCT International Application No. PCT/EP2018/086842, dated Feb. 5, 2019.

*Primary Examiner* — Peggy A Neils
(74) *Attorney, Agent, or Firm* — McDonnell Boehnen Hulbert & Berghoff LLP

(57) ABSTRACT

Example embodiments relate to movable lens luminaires. One example luminaire head includes a first support that includes a plurality of light sources. The luminaire head also includes a second support that includes a plurality of lens elements associated with the plurality of light sources. A lens element of the plurality of lens elements has an internal surface facing a light source of the plurality of light sources and an external surface. Further, the luminaire head includes a moving means configured to move the second support with respect to the first support, such that a position of the plurality of lens elements geometrically projected on a surface of the first support is changed. The lens element has a varying profile seen in a movement direction of the moving means. The lens element includes a prismatic portion, a collimator portion, or a diffusor portion.

21 Claims, 16 Drawing Sheets

(58) Field of Classification Search
CPC ..... F21V 5/007; F21V 7/0083; F21V 14/06; F21V 14/065; F21V 13/04; F21V 13/045; F21V 21/15; F21V 17/02; F21V 19/02; F21V 23/0457; F21V 23/0471; F21V 14/04; F21W 2131/103
See application file for complete search history.

(56) References Cited

U.S. PATENT DOCUMENTS

| | | | |
|---|---|---|---|
| 2008/0273324 | A1 | 11/2008 | Becker et al. |
| 2018/0039073 | A1 | 2/2018 | Low et al. |

FOREIGN PATENT DOCUMENTS

| | | | |
|---|---|---|---|
| EP | 2876364 | A1 | 5/2015 |
| EP | 3165818 | A1 | 5/2017 |
| FR | 3016426 | A1 | 7/2015 |
| GB | 2474921 | A | 5/2011 |
| JP | 2012113924 | A | 6/2012 |
| WO | 2014013477 | A1 | 1/2014 |
| WO | 2014147524 | A1 | 9/2014 |

* cited by examiner

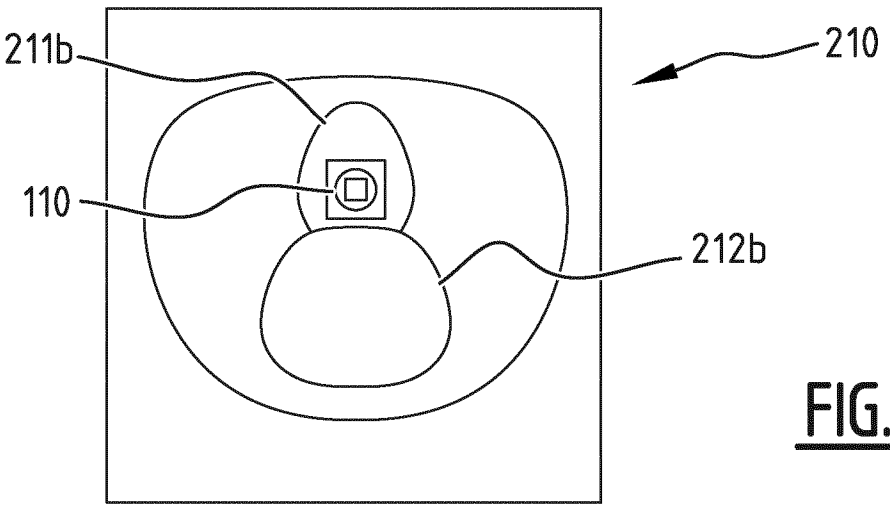
FIG. 13D
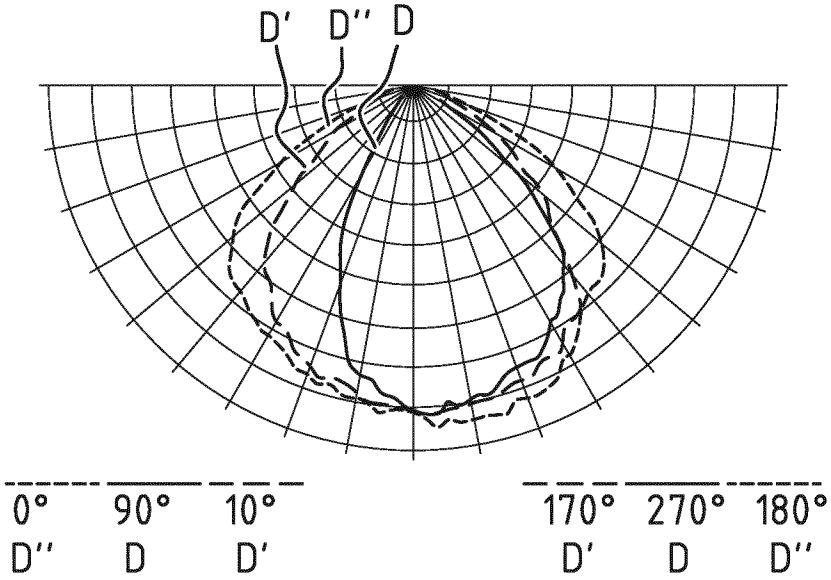
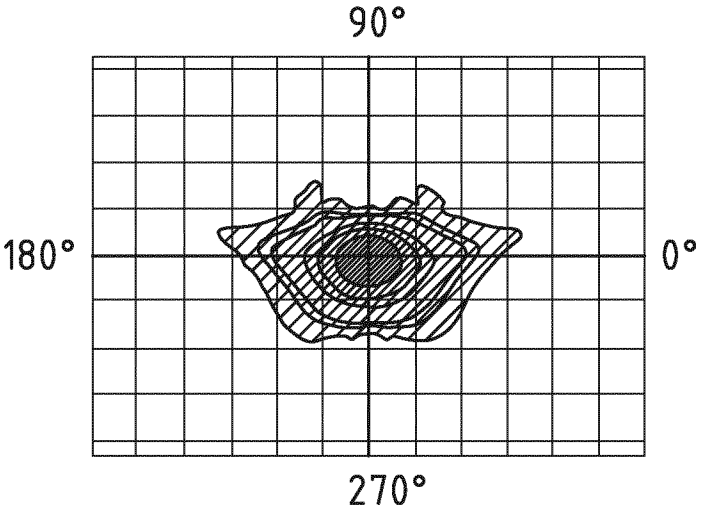

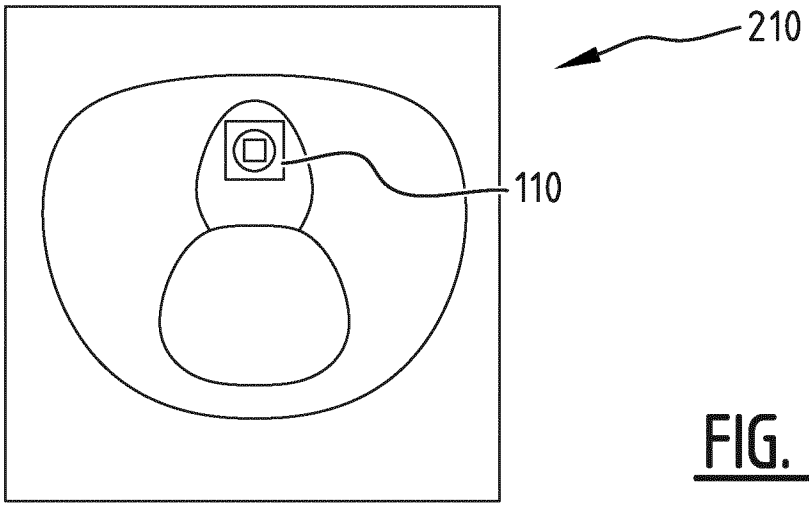
FIG. 13E
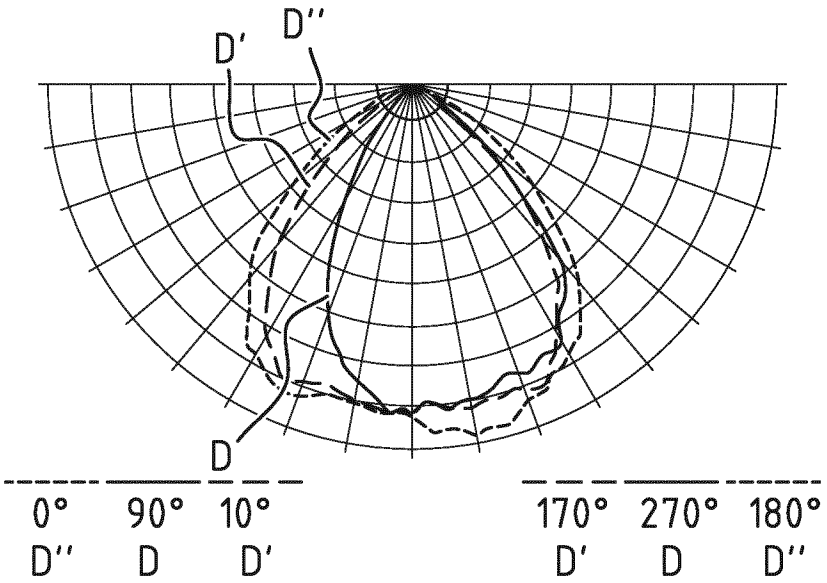
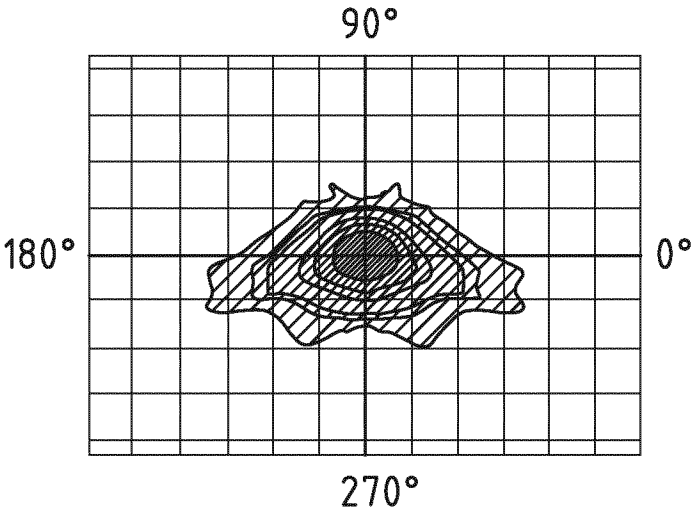

MOVEABLE LENS LUMINAIRE

CROSS-REFERENCE TO RELATED APPLICATIONS

The present application is a continuation of U.S. Application Ser. No. 16/960,295, filed Jul. 6, 2020; which is a national stage entry of PCT/EP2018/086842 filed Dec. 24, 2018; which claims priority to BE 2018/5004 filed Jan. 5, 2018. The contents of each of which are hereby incorporated by reference.

FIELD OF INVENTION

The present invention relates to luminaire heads. Particular embodiments relate to a luminaire head with adjustable photometry.

BACKGROUND

Currently, in the luminaire production, it is necessary to design a specific printed circuit board (PCB) serving as a support for light sources together with a specific optical element type and shape for each luminaire application, e.g. pedestrian road, highway, one-way road, etc. It depends notably on the desired light distribution on the surface to be illuminated, i.e. the desired shape of the light onto the illuminated surface. Such approach is costly, time consuming, and requires extensive stock keeping. It would therefore be advantageous to be able to design a luminaire head with a more adaptive approach for which the photometry can be modified on site, depending on the application and the desired light distribution.

Several solutions exist for outdoor lighting equipment presenting optical elements adjustable on an individual basis or within relatively restricted boundaries. However, the flexibility of use of the luminaire heads remains limited and there is a need for a luminaire head which can be adapted to each site and desired usage.

SUMMARY

The object of embodiments of the invention is to provide a luminaire head whose light distribution can be varied and which is more adaptable to each site to be illuminated and/or to a specific application. More in particular, embodiments of the invention aim to provide a luminaire head for which the photometry can be adjusted on site and/or at the factory.

According to a first aspect of the invention there is provided a luminaire head. The luminaire head comprises:

- a first support comprising a plurality of light sources;
- a second support comprising a plurality of lens elements associated with the plurality of light sources;
- a moving means configured to move the second support with respect to the first support, such that a position of the plurality of lens elements geometrically projected on a surface of the first support is changed.

Embodiments of the invention are based inter alia on the insight that a common solution to adapt a luminaire head to a specific use or site is to mount optical elements specified for the corresponding use or site. Installing different optical elements depending on the site or desired use makes the installation task unnecessarily complicated. Moreover it adds the disadvantage of having to store several optical elements models for production and/or for maintenance. This problem is overcome by a luminaire head as defined above.

The light emitted by the plurality of light sources of the first support will be distributed in a certain manner by the plurality of lens elements comprised on the second support and associated with the plurality of light sources. Having the plurality of light sources and the plurality of lens elements on different supports allow making independent the positioning of one with respect to the other. Indeed, the moving means will allow altering this positioning. By changing the position of the plurality of lens elements, the light distribution on the surface to be illuminated will be changed as well. In such a way, the light emitted and its distribution may be correlated to different positions of the plurality of lens elements with respect to the positions of the plurality of light sources and can be adapted more easily to different sites and/or applications without having to mount different optical components. Changing the light distribution may be done at the factory, during installation as well as during occasional or everyday usage of the luminaire head. More in particular, embodiments of the invention allow a dynamic adaptation of the light distribution of the luminaire head, based, for example, on changes occurring in its environment. Additionally, the adaptability is made easier by the common movement of the plurality of lens elements rather than on an individual basis. At the same time embodiments of the invention lessen the number of parts to be kept in stock for maintenance. In other embodiments, changing the position of the plurality of lens elements may be done to compensate for mounting or apparatus inaccuracies.

In the context of the invention, a lens element may include any transmissive optical element that focuses or disperses light by means of refraction. It may also include any one of the following: a reflective portion, a backlight portion, a prismatic portion, a collimator portion, a diffusor portion. For example, a lens element may have a lens portion with a concave or convex surface facing a light source, or more generally a lens portion with a flat or curved surface facing the light source, and a collimator portion integrally formed with said lens portion, said collimator portion being configured for collimating light transmitted through said lens portion. Also, a lens element may be provided with a reflective portion or surface or with a diffusive portion.

Preferred embodiments relate to a luminaire head of an outdoor luminaire. By outdoor luminaire, it is meant luminaires which are installed on roads, tunnels, industrial plants, campuses, cycle paths, pedestrian paths or in pedestrian zones, for example, and which can be used notably for the lighting an outdoor area, such as roads and residential areas in the public domain, private parking areas, access roads to private building infrastructures, etc.

In the context of this invention, when specifying that the second support is moved with respect to the first support, it is implied that the second support and/or the first support may be moved, i.e. the first support may be fixed and the second support may be moved, or the second support may be fixed and the first support may be moved, or both the first and the second support may be moved.

According to a preferred embodiment, the luminaire head further comprises:

- a controlling means configured to control the moving means, such that the movement of the second support with respect to the first support is controlled.

In this manner, moving the second support with the moving means is more precise for the positioning of the plurality of lens elements. A greater precision of the movement will lead to a greater adaptability of the luminaire head.

According to an exemplary embodiment, the first support is mounted substantially parallel to the second support; and the moving means is configured to move the second support substantially parallel to the first support.

In this way, changes in the light distribution can be associated to changes in the profile or optical properties, for example changes in the shape, and/or thickness, and/or transparency, and/or reflectivity, and/or diffusivity and/or refractivity of the plurality of lens elements in the direction of movement. In the case of the first support being mounted substantially parallel to the second support and moving the same way, lens elements such as non-spherical lenses are preferred.

According to a preferred embodiment, a lens element of the plurality of lens elements has a first surface and a second surface located on opposite sides thereof, wherein the first surface is a convex or planar surface and the second surface is a concave or planar surface facing a light source of the plurality of light sources.

In this manner, the light source placed at the second surface side of the lens element has its emitted light being spread. The shape of the lens element and position of the lens element with respect to the light source will influence the distribution and intensity profile of the emitted light.

According to a preferred embodiment, a lens element of the plurality of lens elements has an internal dimension D seen in a movement direction of the moving means; and the controlling means is configured to control the moving means such that the second support is moved over a distance below 90% of the internal dimension D of the lens element, preferably below 50% of the internal dimension D of the lens element.

In an embodiment with a lens element with a concave or planar second surface, the internal dimension D corresponds to the distance between the boundaries of the cavity facing the corresponding light source in the moving direction.

In this manner, changes in the light distribution are achieved by changes in the profile of a lens element in the direction of movement. Movements would only need to be limited such that the light emitted by the light sources is distributed in an adequate manner by the corresponding lens elements. The mentioned adequate manner can correspond to a movement whose distance is below 90%, preferably 50%, of the internal dimension D of the lens element such that the light sources can be kept in correspondence with their respective lens elements. In another embodiment, the luminaire head comprises more lens elements than light sources, and the controlling means is configured to control the moving means such that the second support is moved relative to the first support in such a way that a given light source is moved from one lens element to another lens element.

According to an exemplary embodiment, the controlling means is configured to control the moving means to position the plurality of lens elements in a plurality of positions resulting in a plurality of lighting patterns on a surface. A lighting pattern corresponds with an illuminated surface area on said surface. The plurality of lighting patterns has a plurality of different illuminated surface areas.

In this way, the luminaire head has a greater variety of light distributions and is more adaptable to different uses or sites.

According to a preferred embodiment, the luminaire head further comprises:

a guiding means configured for guiding the movement of the second support with respect to the first support, wherein the guiding means comprises a first sliding guide and a second sliding guide parallel to the first sliding guide, said first and second sliding guide extending in a direction of movement of the moving means.

In this manner, the movement of the second support is more controlled in a direction substantially parallel to the first support which results in a greater accuracy of the positioning of the lens elements respective to the light sources.

According to an exemplary embodiment, the second support is arranged to move in contact with the first support.

In this way, the distance between the first support and the second support is zero and fixed, which allows for a better determination of the expected light distribution corresponding to different positions of the second support with respect to the first support.

According to another exemplary embodiment, the second support is arranged to move at a fixed distance of the first support, e.g. a PCB. To that end, the first support may be provided with distance elements on which the second support is movably supported. Optionally, a surface of the second support facing the first support, or a surface of the first support facing the second support, may be provided with tracks or guides cooperating with the distance elements. Such tracks or guides may be formed integrally with the rest of the second support, or with the rest of the first support, respectively. Optionally, the distance elements may be adjustable in order to adjust the distance between the first support and the second support. For example, the distance elements may comprise a screw thread cooperating with a bore arranged in/on the first or second support.

In this way, the distance between the first support and the second support is known, which allows for a better determination of the expected light distribution corresponding to different positions of the second support with respect to the first support.

According to a preferred embodiment, the second support comprises a frame and a lens plate integrating the plurality of lens elements, wherein the lens plate is carried by the frame. Also, the frame may carry multiple lens plates together integrating the plurality of lens elements.

In another embodiment, the second support may be the lens plate without a frame. For example, when the lens plate is sufficiently rigid, it may be used without a frame.

In yet another embodiment, the plurality of lens elements may be separately formed and the second support may comprise a frame carrying the plurality of lens elements.

In this manner, the lens elements can be more easily replaced in case of maintenance. Also, the moving of the lens plate/lens elements may be more easily achieved.

According to an exemplary embodiment, the frame comprises a surrounding fixture and a plurality of crossing elements extending between edges of the surrounding fixture. When multiple lens plates are carried by the frame, the crossing elements may extend along adjacent edges of two adjacent lens plates.

In this way, the distance between the lens elements and the light sources is more consistent over the lens plate which allows for a greater reliability on the expected light distribution corresponding to different positions of the second support with respect to the first support.

According to a preferred embodiment, the second support is arranged such that a lens element of the plurality of lens elements extends over a corresponding light source of the plurality of light sources.

In this manner, the light distribution achieved by the light sources associated to the lens elements is done in an adequate manner.

According to an exemplary embodiment, a lens element of the plurality of lens elements has a maximum length different from a maximum width, wherein said length is an internal dimension of the lens element seen in the movement direction of the moving means and said width is an internal dimension of the lens element seen perpendicularly to the movement direction of the moving means.

In this way, a lens element has an outer shape lacking symmetry which allows a change in the light distribution when moved.

According to an exemplary embodiment, a lens element of the plurality of lens elements has a varying profile seen in a movement direction of the moving means.

In this way, the change in the light distribution caused by the moving means can be controlled by choosing an appropriate profile.

According to a preferred embodiment, the luminaire head further comprises:

a sensing means configured to acquire a measure for a position of the second support relative to the first support; and wherein the controlling means is configured to control the moving means in function of the acquired measure.

In this manner, the sensing means can obtain the position of the second support relative to the first support and a specific desired light distribution corresponding to a specific position of the second support can be achieved by the movement of the second support with respect to the first support controlled by the controlling means.

According to an exemplary embodiment, the luminaire head further comprises:

an environment sensing means configured to detect environmental data; and wherein the controlling means is configured to control the moving means in function of the detected environmental data.

In another embodiment, the environment sensing means may be provided to another component of a luminaire, e.g. to a pole of the luminaire, or in a location near the luminaire.

In this way, the environment sensing means can detect environmental data, e.g. luminosity, sound, dynamic object, of the surroundings of the luminaire head. The environment sensing means may already be provided to the luminaire head or may be added in a later phase of the luminaire head installation. Controlling the moving means in function of the detected environmental data may allow changing the light distribution, and thus the lighting pattern of the luminaire head in accordance with the detected environmental data in a more dynamic manner, e.g. compensating luminosity depending on weather, changing to a lighting pattern more adapted for a passing cyclist.

According to a preferred embodiment, the luminaire head further comprises:

a pattern sensing means, e.g. a camera, configured to acquire a measure for a lighting pattern produced by the luminaire head; and wherein the controlling means is configured to control the moving means in function of the acquired measure.

In another embodiment, the pattern sensing means may be provided to another component of a luminaire, e.g. to a pole of the luminaire, or in a location near the luminaire.

In this manner, the pattern sensing means can acquire a measure of a lighting pattern associated with a corresponding position of the plurality of lens elements. Then, controlling the moving means in function of the acquired measure will enable a more adapted lighting pattern to be achieved relative to the current environment of the luminaire head. Further, acquiring a measure of the surface area associated with the lighting pattern will enable the correlation between a position of the plurality of lens elements and the resulting lighting pattern.

In an embodiment with a feedback loop, the controlling means may correct, and more in particular may regularly or continuously correct, the position of the plurality of lens elements respective to the plurality of light sources based on sensed data, e.g. data from the pattern sensing means, data from the environment sensing means or data from a sensing means configured to acquire a measure for a position of the second support relative to the first support. It is noted that also data from any sensing means of nearby luminaire heads may be taken into account when correcting the position. For example, if a luminaire is positioned between two other luminaires, the lighting patterns thereof may partially overlap. The lighting pattern measured by the central luminaire may also be used to correct the position of the plurality of lens elements respective to the plurality of light sources of the other two luminaires.

According to an exemplary embodiment, the first support comprises an array of light sources with at least two rows of light sources and at least two columns of light sources.

In this way, the mounting and connecting of the plurality of light sources on the first support is simplified. Similarly, the plurality of lens elements may be arranged in an array of at least two rows and at least two columns.

According to a preferred embodiment, the luminaire head further comprises:

a driver configured to drive the plurality of light sources;

optionally a dimmer configured to control the driver to drive one or more of the plurality of light sources at a dimmed intensity.

In this manner, the energy supplied to the light sources is controlled by the driver. The optional addition of a dimmer would allow obtaining a greater variety of light distributions by varying the light intensity in addition to the positioning of the light sources respective to the lens elements. Preferably, the plurality of light sources is a plurality of LEDs.

According to an exemplary embodiment, the controlling means is configured for controlling the moving means and the driver and optionally the dimmer to control the movement, the intensity, the flashing pattern, the light colour and the light colour temperature, respectively. Preferably, the controlling means is configured to set a particular position of the second support relative to the first support in combination with a light intensity and/or a flashing pattern and/or a light colour and/or a light colour temperature. In the context of the present application "light colour data" can refer to data for controlling a colour (e.g. the amount of red or green or blue) and/or data for controlling a type of white light (e.g. the amount of "cold" white or the amount of "warm" white).

According to an exemplary embodiment, the moving means comprises a linear actuator, preferably a stepper motor. According to another exemplary embodiment, the moving means comprises a bi-metal.

In this way, translational motion of the second support relative to the first support can be carried out.

According to an exemplary embodiment, a lens element of the plurality of lens elements has an internal surface facing a light source of the plurality of light sources and an external surface. The internal surface and/or the external surface may comprise a first curved surface and a second curved surface, said first curved surface being connected to said second curved surface through a connecting surface or line comprising a saddle point or discontinuity. The second support is movably arranged relative to the first support to position the light source either in at least a first position facing the first curved surface or in at least a second position facing the second curved surface. When the external surface is implemented as described, preferably the external surface comprises a first outwardly bulging surface, a second outwardly bulging surface, and an external connecting surface or line connecting said first and second outwardly bulging surfaces. However, it is also possible to have a continuous outer surface and to implement only the internal surface as described. When the internal surface is implemented as described, preferably the internal surface comprises a first outwardly bulging surface, a second outwardly bulging surface, and an internal connecting surface or line connecting said first and second outwardly bulging surfaces. The term "outwardly bulging surface" is used here to refer to a surface which bulges outwardly, away from an associated light source. An outwardly bulging external surface forms a protruding portion, whilst an outwardly bulging internal surface forms a cavity facing an associated light source.

By providing such curved surfaces, the lens element is given a "double bulged" shape allowing to generate distinct lighting patterns depending on the position of the light source with respect to the lens element. More in particular, the shape, the size and the location of the light beam may be different depending on the position of the light source with respect to the lens element. This will allow illuminating various types of roads or paths with the same luminaire head. Also, this will allow adjusting a lighting pattern in function of the height above the surface to be illuminated.

Preferably, each lens element has a circumferential edge in contact with the first support, and the internal connecting surface or line is at a distance of the first support.

Preferably, the first outwardly bulging surface and the first support delimit a first internal cavity, the second outwardly bulging surface and the first support delimit a second internal cavity, and the internal connecting surface or line and the first support delimit a connecting passage between the first and second internal cavity. Such a connecting passage will allow a light source to pass from the first to the second cavity and vice versa. Preferably, a first maximal width (w1) of the first internal cavity, and a second maximal width (w2) of the second internal cavity are bigger than a third minimal width (w3) of the connecting passage between the first and second internal cavity. The first and second maximal width and the third minimal width extend in the same plane, preferably an upper plane of the first support, in a direction perpendicular on the moving direction. The first and second maximal width may also be different. The widths are measured in a lower plane of the lens element, delimiting the open side of the cavities, and the maximum corresponds with a maximum in this plane. When the lens element is supported on the first support, this plane corresponds with a surface of the first support.

Preferably, the first curved surface is at a first maximal distance of the first support, the second curved surface is at a second maximal distance of the first support, and the saddle point or discontinuity is at a third minimal distance of the first support, said third minimal distance being lower than said first and second maximal distance. More preferably, the first and second maximal distance are different. Those characteristics may apply for the external and/or internal curved surfaces.

In an exemplary embodiment, the luminaire head has a fixation end configured for being attached to a pole, the first maximal distance defined above is larger than the second maximal distance defined above, and the lens element is arranged such that the first internal and/or external curved surface is closer to the fixation end of the luminaire head than the second internal and/or external curved surface.

In an exemplary embodiment, the lens element further comprises at least one reflective element configured to reflect a portion of the light emitted by the light source, wherein preferably said at least one reflective element comprises a first reflective surface located at a first edge of the first curved surface and a second reflective surface located at a second edge of the first curved surface, wherein the second edge is an edge near the connecting surface or line and the first edge is opposite the second edge, away from the connecting surface or line. Alternatively or additionally, the light source may be provided with a reflective element. Using one or more reflective elements, light may be directed to the street side of the luminaire in a more optimal manner.

The first and/or second curved surfaces may have a symmetry axis parallel to the moving direction of the lens element. In the example of FIGS. 7A-F, both the first and second curved surfaces have a symmetry axis parallel to the moving direction of the lens element. However, it is also possible to design the first curved surfaces with a symmetry axis whilst giving the second curved surfaces an asymmetric design or vice versa, or to design both the first and the second curved surfaces in an asymmetric manner. This will allow to obtain a symmetrical light beam in a first position of the light source relative to the lens element, and to obtain an asymmetrical light beam in a second position of the light source relative to the lens element.

In the embodiments above a lens element comprises two adjacent curved surfaces bulging outwardly, but the skilled person understands that the same principles can be extended to embodiment with three or more adjacent curved surfaces bulging outwardly. Also, it is possible to provide a lens element with an array of bulged surfaces, e.g. an array of n×m bulged surfaces with n>=1 and m>=1.

The skilled person will understand that the hereinabove described technical considerations and advantages for luminaire head embodiments also apply to the below described corresponding luminaire head control system embodiments, mutatis mutandis.

According to a preferred embodiment, there is provided a luminaire head control system. The luminaire head control system comprises a plurality of luminaire heads preferably according to any one of the embodiments disclosed above, and a remote device. The remote device is configured to send lighting data to the or each luminaire head. The controlling means of the or each luminaire head is further configured for controlling the moving means based on the lighting data received by the luminaire head. Lighting data may comprise e.g. dimming data, switching data, pattern data, movement data, light colour data, flashing pattern data, light colour temperature data, etc. For example, the movement data for a particular luminaire may be determined by the remote device based on measurement data measured by one or more luminaires. It is further possible to link the movement data to the light colour data and/or to the dimming data and/or to the light colour temperature data and/or to the flashing pattern data, so that the light colour and/or the light intensity and/or the light colour temperature and/or the flashing pattern is changed during the moving or after the moving.

According to an exemplary embodiment, the or each luminaire head is further configured for transmitting measurement data from the pattern sensing means to the remote device. The remote device is further configured to determine lighting data for the or each luminaire head, based on the measurement data.

According to a preferred embodiment, the or each luminaire head is further configured for transmitting environmental data from the environment sensing means to the remote device. The remote device is further configured to determine lighting data for the or each luminaire head, based on the environmental data. Environmental data may comprise e.g. luminosity data, visibility data, humidity data, temperature data, image data, audio data, presence data, etc.

The skilled person will understand that the hereinabove described technical considerations and advantages for luminaire head embodiments also apply to the below described corresponding method embodiments, mutatis mutandis.

According to a preferred embodiment, there is provided a method for controlling a light distribution, preferably the light distribution of a luminaire head. The method comprises moving of a second support comprising a plurality of lens elements with respect to a first support comprising a plurality of light sources, such that a position of the plurality of lens elements geometrically projected on a surface of the first support is changed, resulting in a changed light distribution.

According to an exemplary embodiment, the method further comprises controlling the moving of the second support with respect to the first support, such that the movement of the second support is substantially parallel with respect to the first support.

According to a preferred embodiment, the controlling further comprises controlling the moving of the second support to position the plurality of lens elements in a plurality of positions resulting in a plurality of lighting patterns on a surface, said plurality of lighting patterns having a plurality of different surface areas.

According to an exemplary embodiment, a lens element of the plurality of lens elements has an internal dimension D seen in a movement direction of the moving; and the controlling of the moving is such that the moving of the second support is carried out over a distance below 90% of the internal dimension D of the lens element, preferably below 50% of the internal dimension D of the lens element.

In another embodiment, the controlling of the moving is such that the second support is moved relative to the first support in a such a way that a given light source is moving from one lens element to another lens element.

According to a preferred embodiment, the moving of the second support is arranged such that the first and the second support are in contact.

According to another exemplary embodiment, the moving of the second support is arranged such that the second support moves at a fixed distance of the first support.

According to an exemplary embodiment, the method further comprises:

acquiring a measure for a position of the second support relative to the first support;

controlling the moving of the second support with respect to the first support in function of the acquired measure.

According to a preferred embodiment, the method further comprises:

detecting environmental data;

controlling the moving of the second support with respect to the first support in function of the detected environmental data.

According to an exemplary embodiment, the method further comprises:

acquiring a measure for a lighting pattern;

controlling the moving of the second support with respect to the first support in function of the acquired measure.

BRIEF DESCRIPTION OF THE FIGURES

This and other aspects of the present invention will now be described in more detail, with reference to the appended drawings showing a currently preferred embodiment of the invention. Like numbers refer to like features throughout the drawings.

FIGS. 13A-E illustrate light distributions for the lens element of FIGS. 12A and 12B in various positions of a light source relative to the lens element.

DESCRIPTION OF THE FIGURES

Figure 1:
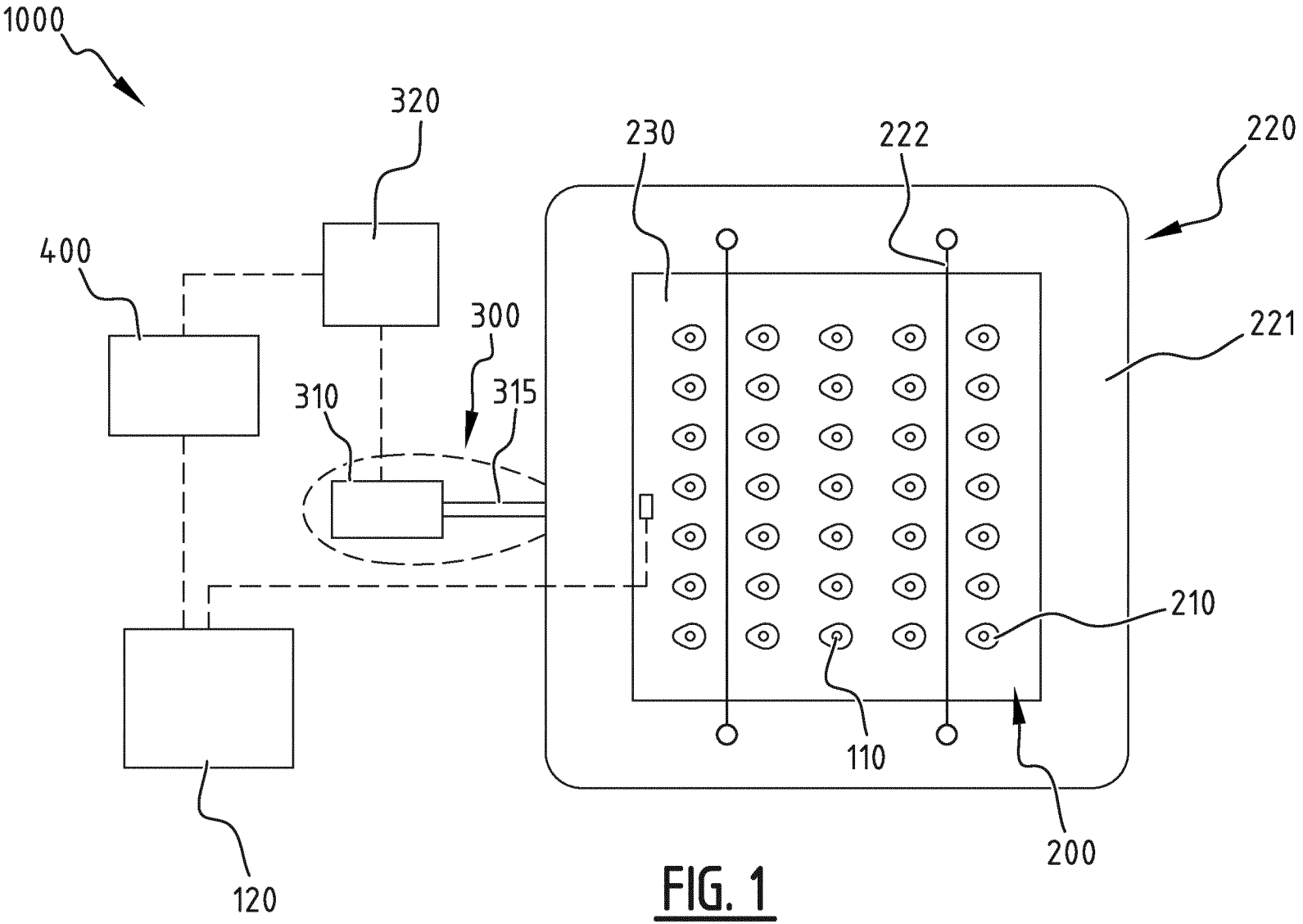
FIG. 1 illustrates schematically a top view of an exemplary embodiment of a luminaire head according to the invention.
Figure 2:
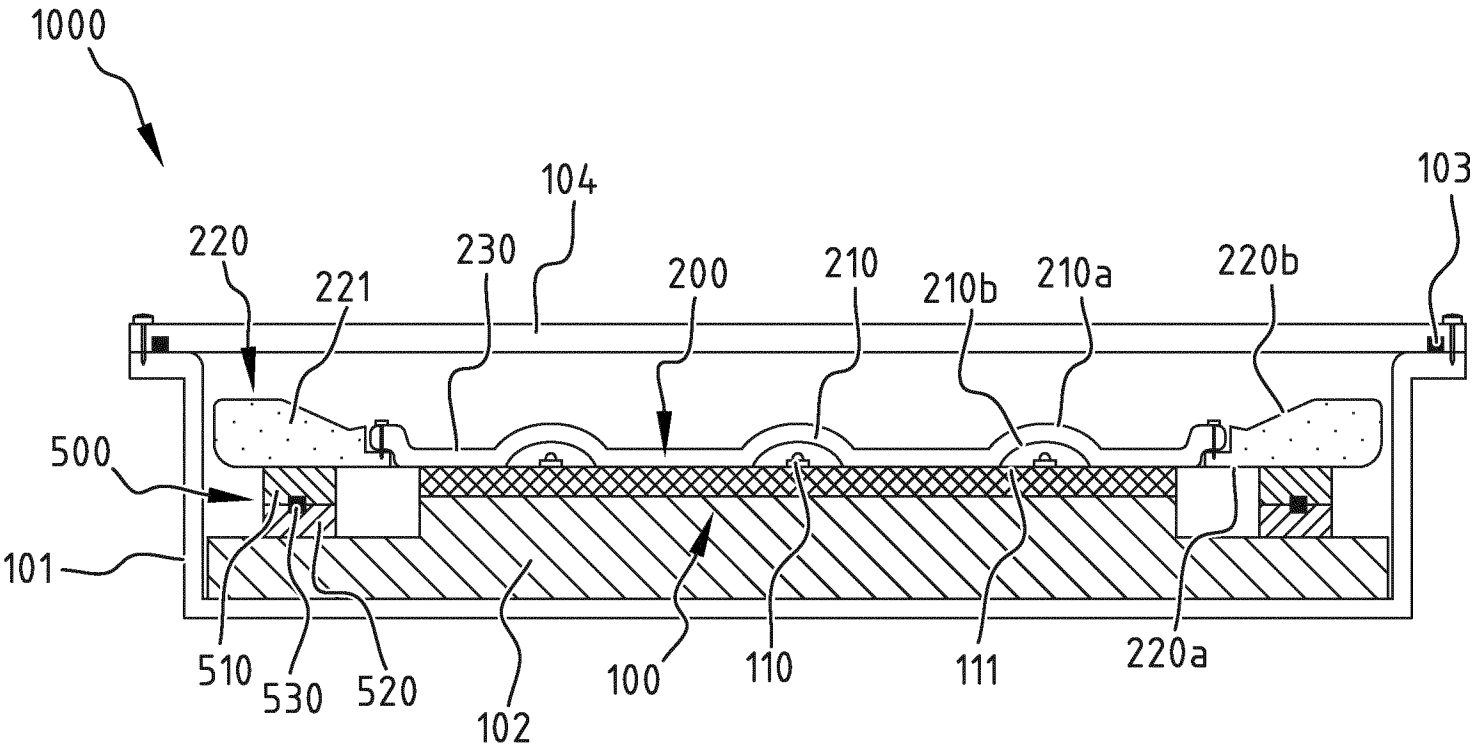
FIG. 2 shows a cross-sectional view of an exemplary embodiment of a luminaire head according to the invention.
Figure 3A:
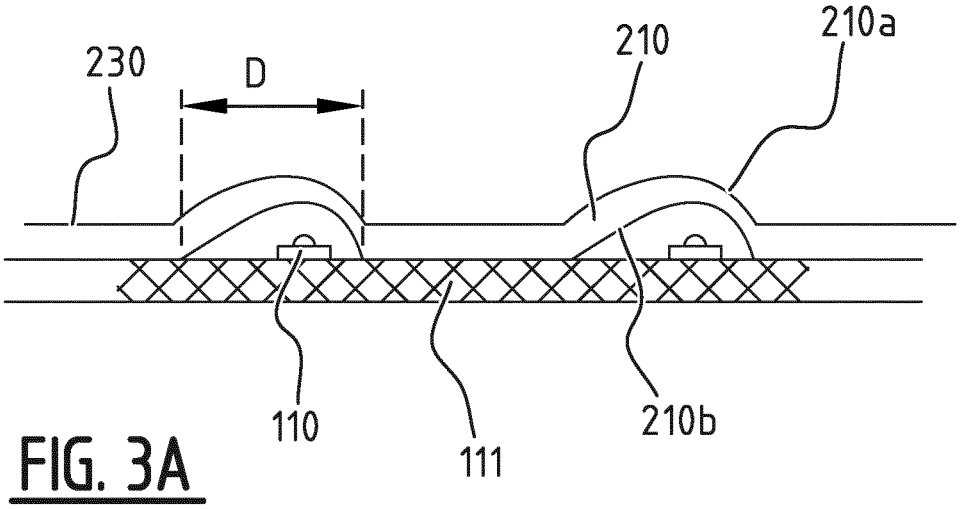
FIGS. 3A-3C show cross-sectional views of other exemplary embodiments of lens elements of a luminaire head according to the invention.

FIG. 1 illustrates schematically a top view of an exemplary embodiment of a luminaire head according to the present invention. FIG. 2 illustrates schematically a more detailed exemplary embodiment of the embodiment shown in FIG. 1. FIG. 3A illustrates schematically a more detailed exemplary embodiment of the embodiment shown in FIG. 1. FIG. 2 shows a cross-sectional view of an exemplary embodiment of a luminaire head according to the invention. Like numbers utilized in FIGS. 1, 2, and 3A refer to like features throughout the drawings.

The luminaire head 1000 comprises a first support 100, a second support 200, and a moving means 300. The first support 100 comprises a plurality of light sources 110. The first support 100 may comprise a supporting substrate 111, e.g. a PCB, and a heat sink 102 onto which the supporting substrate 111 may be mounted. A housing 101 may be arranged around the first support 100 and may comprise a planar surface onto which the first support 100 is provided. In the exemplary embodiment of FIGS. 1 and 2, the plurality of light sources 110 comprises a plurality of LEDs. Further, each light source 110 may comprise a plurality of LEDs, more particularly a multi-chip of LEDs.

The plurality of light sources 110 may be arranged without a determined pattern or in an array with at least two rows of light sources 110 and at least two columns of light sources 110, in the illustrated embodiment of FIG. 1 an array of seven rows by five columns. The LEDs may be disposed on the PCB 111 and mounted on top of a planar surface of the heat sink 102 made of a thermally conductive material, e.g. aluminium. The surface onto which the plurality of light sources 110 is mounted on can be made reflective or white to improve the light emission. The plurality of light sources 110 could also be light sources other than LEDs, e.g. halogen, incandescent, or fluorescent lamp.

The second support 200 comprises a plurality of lens elements 210 associated with the plurality of light sources 110. The plurality of lens elements 210 is mounted such that each of the plurality of light sources 110 is covered by a lens element 210. In other embodiments, some of the plurality of light sources may not be associated with a lens element 210. In the exemplary embodiment shown in FIGS. 1 and 2, the lens elements 210 are similar in size and shape and there is one lens element 210 for each light source 110. In another embodiment, at least one lens element 210 may not extend over a corresponding light source of the plurality of light sources. In another exemplary embodiment, some or all of the lens elements 210 may be different from each other. In a further exemplary embodiment, there are more lens elements 210 than light sources 110. In other embodiments, there may be provided a plurality of LEDs below some or all of the lens elements 210.

The lens element 210 may be free form in the sense that it is not rotation symmetrical, in the illustrated embodiment of FIG. 3A lens elements 210 have a symmetry axis along an internal dimension D of the lens elements 210. The internal dimension D is defined as the dimension of the lens element 210 on a side facing the plurality of light sources 110 along a movement direction as described in a later paragraph. The lens element 210 comprises a first surface 210*a* and a second surface 210*b* located on opposite sides. The second surface 210*b* faces the plurality of light sources 110. The first outer surface 210*a* is a convex surface. The second inner surface 210*b* is a concave surface, but may also be a planar surface.

The plurality of lens elements 210 may have a maximum length different from a maximum width. The lens element 210 length is defined as an internal dimension on a side facing the plurality of light sources 100 seen in the movement direction, and the lens element 210 width is defined as an internal dimension on a side facing the plurality of light sources 100 seen perpendicularly to the movement direction as described in a later paragraph. The lens elements 210 are in a transparent or translucent material. They may be in optical grade silicone, glass, poly(methyl methacrylate) (PMMA), polycarbonate (PC), or polyethylene terephthalate (PET).

The plurality of lens elements 210 shown in FIGS. 1, 2, and 3A may be part of an integrally formed lens plate 230. In other words the lens elements 210 may be interconnected so as to form a lens plate 230 comprising the plurality of lens elements 210. The lens plate 230 may be formed, e.g. by injection moulding, casting, transfer moulding or in another appropriate manner. Alternatively, the lens elements 210 may be separately formed, e.g. by any one of the above mentioned techniques.

In the exemplary embodiment of FIGS. 1 and 2, the second support 200 comprises a frame 220 and the lens plate 230 is carried by the frame 220. In other non-illustrated embodiments, the frame 220 may carry multiple lens plates 230. The frame 220 may be a rectangular plate with a first surface 220*a* facing the plurality of light sources 110 and a second surface 220*b* opposite of the first surface 220*a*. There may be a rectangular through-hole centred in the frame 220 such that it defines a surrounding fixture 221 which surrounds the plurality of light sources 110. The lens plate 230 may be mounted on the first or second surface 220*a*, 220*b* of the frame 220, on the second surface 220*b* in the illustrated embodiment of FIG. 2.

As illustrated in the embodiment of FIG. 1, the frame 220 may comprise the surrounding fixture 221 and a plurality of crossing elements 222 extending between edges of the surrounding fixture 221, e.g. two crossing elements. The two crossing elements 222, as shown in the embodiment of FIG. 1, may comprise holding fixtures in contact with the lens plate 230 at fixed intervals and configured for holding the lens plate 230, such that the lens plate 230 is kept at a pre-configured distance relative to the plurality of light sources 110. The lens plate 230 may be in contact with the supporting substrate 111 of the plurality of light sources 110. The crossing elements 222 may be grid-like elements such as described in embodiments of patent EP2966346 in the name of the applicant. The contents of the mentioned patent are here included by reference. In EP2966346, the grid-like elements are connected to the first and the second support 100, 200. The skilled person understands that in an embodiment the grid-like elements may be connected only to the second support 200.

The moving means 300 is configured to move the second support 200 with respect to the first support 100, such that a position of the plurality of lens elements 210 geometrically projected on a surface of the first support 100 is changed. In the exemplary embodiment of FIG. 2, the second support 200 is arranged to move in contact with the first support 100. A controlling means 400 may be configured to control the moving means 300, such that the movement of the second support 200 with respect to the first support 100 is controlled. Furthermore, the first support 100 may be mounted substantially parallel to the second support 200. And the moving means 300 may be configured to move the second support 200 substantially parallel to the first support 100.

In the exemplary embodiment of FIG. 1, the moving means 300 comprises a linear actuator 310, e.g. a stepper motor, a servo motor, a piezo actuator. The linear actuator 310 may be coupled substantially perpendicularly to the second support 200, by a rod 315 in the illustrated embodiment of FIG. 1. The movement direction induced by the moving means 300 may be translational. The plurality of lens elements 210 may have an internal dimension D seen in a movement direction of the moving means 300, as illustrated in the exemplary embodiment of FIG. 3A. The controlling means 400 may be configured to control the moving means 300 such that the second support 200 is moved over a distance below 90% of the internal dimension D of the lens element 210, preferably below 50% of the internal dimension D of the lens element 210.

In another embodiment, the actuator 310 may be coupled to the first support 100, and the moving means 300 may be configured to move the first support 100 relative to the second support 200. The first support 100 may comprise the PCB 111 with the plurality of light sources 110, as well as the heat sink 102 fixed to the PCB 111. In still another embodiment, the moving means 300 may comprise a rotating actuator 310 and the movement induced by the moving means 300 may include a rotational movement. The controlling means 400 may be configured to control the moving means 300 to position the plurality of lens elements 210 in a plurality of positions resulting in a plurality of lighting patterns on a surface. A lighting pattern corresponds with an illuminated surface area on said surface. The plurality of lighting patterns has a plurality of different illuminated surface areas.

An actuator driver 320 is driving the linear actuator 310. A light driver 120 is configured to drive the plurality of light sources 110. Optionally the light driver 120 and the actuator driver 320 may be integrated in a single driver component. As an option, there may be a dimmer configured to control the driver 120 to drive one or more of the plurality of light sources 110 at a dimmed intensity. Also the dimmer may be integrated into the same driver component. The light driver 120 and the actuator driver 320 may be controlled by a common controlling means 400 or by independent controlling means 400, in the illustrated embodiment of FIG. 1 a common controlling means 400. Instructions to the controlling means 400, for example the position of the second support 200 with respect to the first support 100 and/or the dimming profile of the light sources 110 and/or a light colour and/or a light pattern and/or a flashing pattern and/or a light colour temperature, may be given by the user or the remote device 2000 (may be located in another luminaire) via a wireless network, e.g. Bluetooth, Wifi, Zigbee, LORA (IoT), IR, or via a wired network, e.g. Ethernet, DALI, DMX, RS485, USB. Alternatively, the controlling means 400 may determine locally for example the position of the second support 200 with respect to the first support 100 and/or the dimming profile of the light sources 110 and/or a light colour and/or a light pattern and/or a flashing pattern and/or a light colour temperature, based on data sensed locally.

In an exemplary embodiment, the controlling means 400 and the light driver 120 may be configured to control the plurality of light sources 110 according to a plurality of control schemes comprising at least: a first control scheme for which the plurality of light sources 110 are switched on; a second control scheme for which at least one light source 110 of the plurality of light sources 110 is switched off and at least one light source 110 of the plurality of light sources 110 is switched on. Each light source 110 may be switched on in a dimmed or undimmed state.

In another exemplary embodiment, instructions may be sent to the controlling means 400 which is connected to the light driver 120 of the light sources 110 for controlling the dimming profile via, for example, DALI protocol, 0-10V, or DMX. A control unit part of the controlling means 400 is also connected to the actuator driver 320 for controlling the linear stepper motor 310 in the moving means 300 that will generate the displacement of the second support 200 relative to the first support 100. A sensor (not shown) may be located on the linear stepper motor 310 so as to determine the relative position of the second support 200 compared to the first support 100. In such an exemplary embodiment, the second support 200 might have a displacement relative to the first support 100 between 0.1 mm to 5 mm by steps of 0.1 mm to 0.5 mm, with a precision of preferably 0.03 mm.

One or more additional sensing means (not shown) may also be provided to the luminaire head 1000 such as an environment sensing means or a pattern sensing means. The environment sensing means and/or the pattern sensing means may be provided to the luminaire head 1000, or may be provided to any other component associated with the luminaire head, e.g. to the support pole carrying the luminaire head. Also, the sensing means may be added in a later phase of the luminaire head installation. The environment sensing means may detect environmental data, e.g. luminosity, sound, dynamic object, of the surroundings of the luminaire head 1000. Controlling the moving means 300 in function of the detected environmental data may allow changing the lighting pattern of the luminaire head 1000 in accordance with the detected environmental data in a more dynamic manner, e.g. compensating luminosity depending on weather, changing to a lighting pattern more adapted for a passing cyclist, etc.

The pattern sensing means, e.g. camera, may acquire a measure of a lighting pattern associated with a corresponding position of the plurality of lens elements. Then, controlling the moving means 300 in function of the acquired measure will enable a more adapted lighting pattern to be achieved relative to the current environment of the luminaire head. Further, acquiring a measure of the illuminated surface area associated with the lighting pattern will enable the correlation between a position of the plurality of lens elements and the resulting lighting pattern based on the acquired measure of the position of the second support 200 compared to the first support 100. In addition, additional parameters of the luminaire head 1000, e.g. light source intensity, color, dimming, may be controlled in function of the acquired data by the different sensors.

A feedback loop may allow a more precise positioning of the plurality of lens elements 210 respective to the plurality of light sources 110 by controlling the moving means 300 based on data continuously supplied by the one or more sensing means.

Each lens element 210 of the plurality of lens elements may have a varying profile or varying optical properties along the internal dimension D. Each lens element 210 of the plurality of lens elements has a first surface 210*a* and a second surface 210*b* located on opposite sides thereof, wherein the first surface 210*a* is a convex surface and the second surface 210*b* is a concave surface facing the plurality of light sources 110. The profile variation or the variation of the optical properties may be a shape variation along the internal dimension D of the lens element 210, a thickness variation between the first and the second surface 210*a*, 210*b*, and/or a variation of transparency and/or diffusivity and/or reflectivity and/or refractivity. A translucent or transparent cover 104 may be placed over the plurality of lens elements 210 and mounted on the housing 101. The cover 104 may comprise a portion in optical grade silicone, glass, poly(methyl methacrylate) (PMMA), polycarbonate (PC), or polyethylene terephthalate (PET). A seal 103 may be added between the housing 101 and the translucent or transparent cover 104 to improve the protection of the luminaire head 1000, e.g. up to an IP66 rating.

The moving means 300 is configured to move the second support 200 with respect to the first support 100 such that the position of the plurality of lens elements 210 geometrically projected on a surface of the first support 100 is changed. The movement of the second support 200 with respect to the first support 100 may be assisted by a guiding means 500. The guiding means 500 is configured for guiding the movement of the second support 200 with respect to the first support, wherein the guiding means 500 comprises a first sliding guide 510 and a second sliding guide 520 parallel to the first sliding guide 510, said first and second sliding guide 510, 520 extending in a direction of movement of the moving means 300. The guiding means 500 may also comprise additional assisting elements, e.g. ball bearings 530. Additionally, the guiding means 500 may comprise electro-mechanical or magnetic elements to improve the steering of the movement of the second support 200. In the exemplary embodiment of FIG. 2 the first sliding guide 510 is mounted on the second support 200 and facing the second sliding guide 520 mounted on top of the inner mounting support 102. In another embodiment, the guiding means 500 may be mounted on a side of the second support frame 220 and an inner surface of the housing 101.

Figure 6:
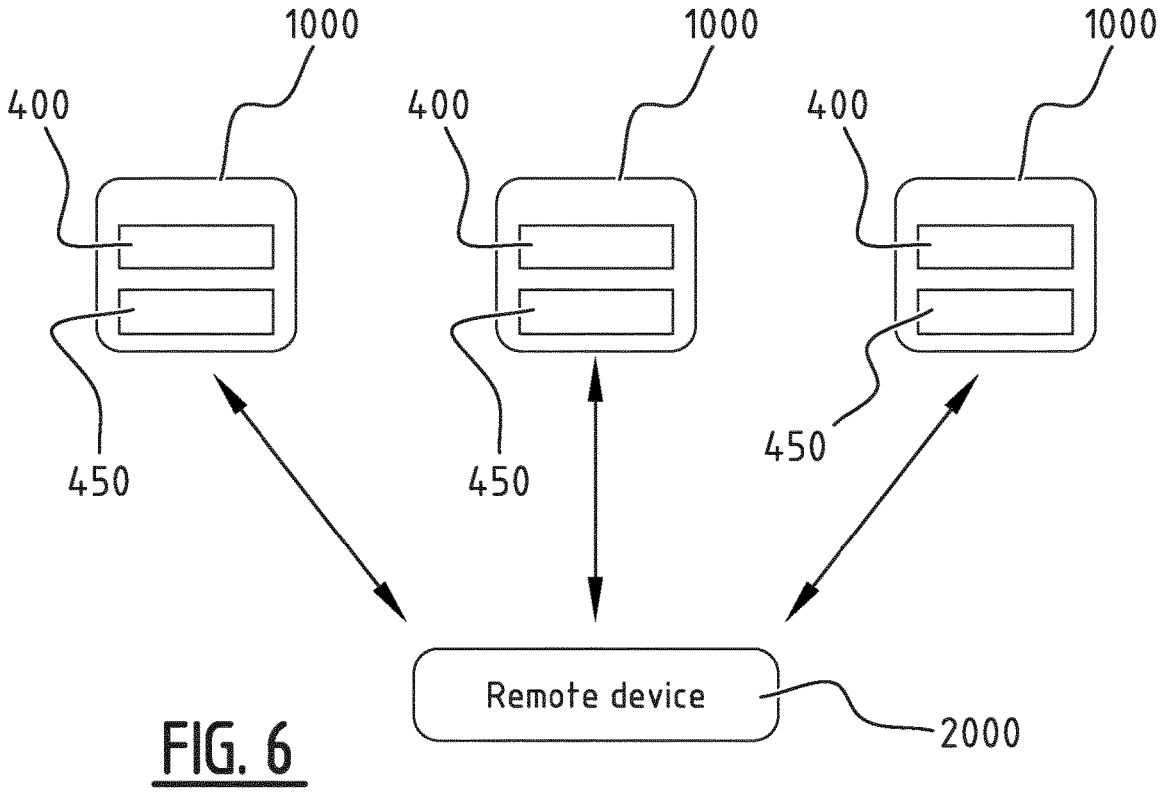
FIG. 6 shows a flowchart of a luminaire head control system according to the invention.

In FIG. 6, the luminaire head 1000 may be part of a plurality of substantially similar luminaire heads comprised in a luminaire control system. Each of the plurality of luminaire heads 1000 may comprise a communication interface 450 and a controlling means 400. The communication interface 450 is configured for communicating with a remote device 2000. The controlling means 400 is further configured for controlling the communication through the communication interface 450.

The remote device 2000 is configured to determine lighting data for each luminaire head 1000, said lighting data indicating the lighting pattern to be achieved by the luminaire head 1000. The luminaire head controlling means 400 is further configured for receiving the lighting data and for controlling the moving means 300 accordingly. It is to be noted that the controlling means 400 may be one controlling means or a plurality of controlling means.

The remote device 2000 may achieve communication via a wireless network, e.g. Bluetooth, Wifi, Zigbee, LORA (IoT), IR, or via a wired network, e.g. Ethernet, DALI, DMX, RS485, USB. The remote device 2000 may be a remote server communicating with the plurality of luminaire heads 1000. The remote device 2000 is defined as remote in the sense that it is remote from at least one luminaire head 1000 of the plurality of luminaire heads. Additionally, the remote device 2000 may be comprised in the at least one luminaire head 1000 of the plurality of luminaire heads or in a cabinet near a plurality of luminaires.

In an exemplary embodiment, the remote device 2000 may comprise an internal clock. The remote device may communicate lighting data according to a predetermined lighting schedule for each luminaire head 1000 or according to a time of the day, based on the time of the internal clock. In another exemplary embodiment, measurement data from the environment sensing means and/or pattern sensing means of at least one luminaire head 1000 of the plurality of luminaire heads may enable the detection of a malfunction of the at least one luminaire head 1000. The remote device 2000 may determine lighting data to compensate for the at least one malfunctioning luminaire head 1000. In still another exemplary embodiment, measurement data from the environment sensing means may enable the detection of a change in the visibility conditions, e.g. due to heavy rain, fog, snow, or of a moving object. The remote device 2000 may determine lighting data to locally modify the luminaire heads light distribution to adapt to the changing visibility conditions or to the future passing of the moving object.

Figure 3B:
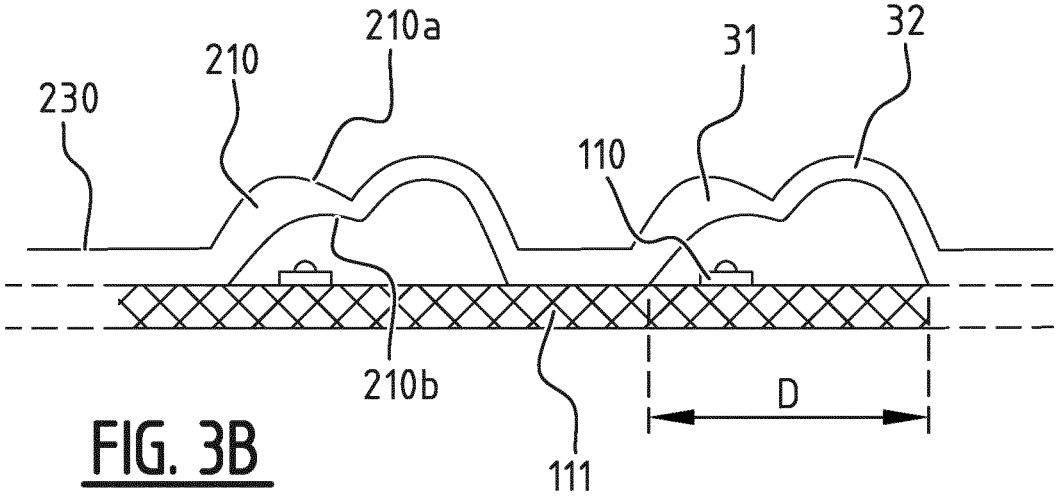
Figure 3C:
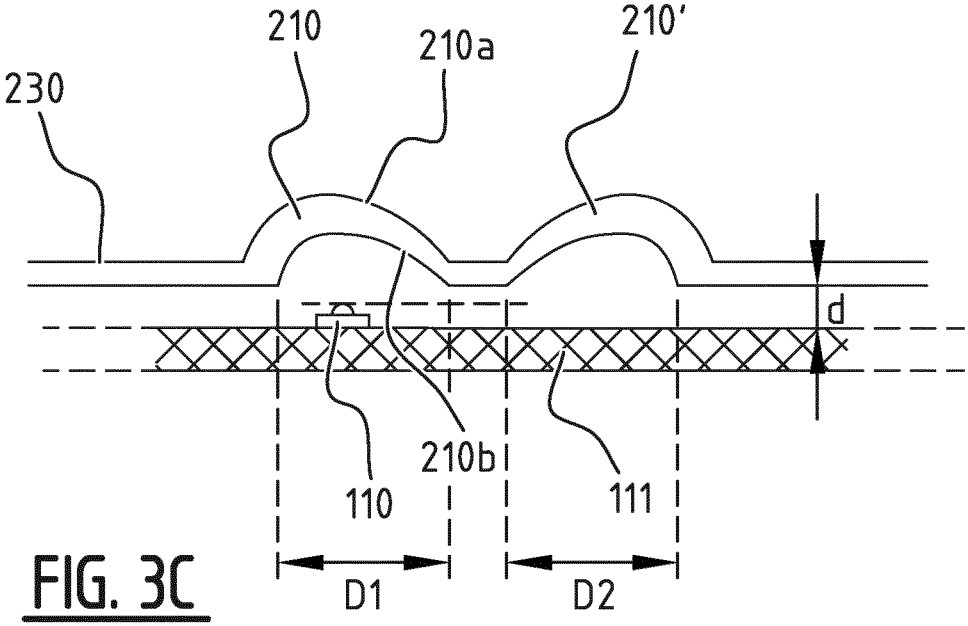

FIGS. 3A-3C show cross-sectional views of other exemplary embodiments of lens elements according to the present invention. The luminaire head comprises a first support 100 comprising a plurality of light sources 110, in the illustrated embodiments LEDs, and a second support 200 comprising a plurality of lens elements 210 associated with the plurality of light sources 110.

In the exemplary embodiments of FIGS. 3A-3C the plurality of LEDs 110 are mounted on a PCB 111 and the plurality of lens elements 210 are integrated in a lens plate 230. The lens plate 230 is in contact with the PCB 111 in the illustrated embodiment of FIGS. 3A-3B, and at a preconfigured distance d relative to the PCB 111 in the illustrated embodiment of FIG. 3C.

Each of the plurality of lens elements 210 has a first external surface 210*a* and a second internal surface 210*b* facing the plurality of light sources 110 opposite of the first surface 210*a*. The first surface 210*a* is a convex surface and the second surface 210*b* is a concave surface. Each lens element 210 of the plurality of lens elements 210 has a varying profile along an internal dimension D in the moving direction of the plurality of lens elements 210.

In the exemplary embodiment of FIG. 3A, a lens element 210 of the plurality of lens elements 210 has a symmetry axis in the moving direction. The lens element 210 has a profile varying in thickness, e.g. from a thicker end to a thinner end, seen in the movement direction. The varying profile presents an asymmetric shape with respect to a centre plane perpendicular to the movement direction. Moving the plurality of light sources 110 from one end to the other end of the plurality of lens elements 210 may modify the light distribution such that a maximum width of the lighting pattern projected on a surface area is changed.

In the exemplary embodiment of FIG. 3B, a lens element 210 of the plurality of lens elements 210 has a first profile part 31 and a second profile part 32 adjoined in a discontinuous manner. The first profile part 31 presents a shape and a thickness variation along its length. The second profile part 32 presents a bell shape and a constant thickness along its length. Moving the plurality of light sources 110 such that the plurality of light sources 110 corresponds to the first profile part 31 or the second profile part 32 may further modify the lighting pattern obtained from the luminaire head 1000. In the illustrated embodiment of FIG. 3B, the internal dimension D is defined as the added dimensions of the first and second profile part 31, 32 on a side facing the plurality of light sources 110 along the movement direction.

FIGS. 7A-7E illustrate in more detail another embodiment of a "double bulged" lens element suitable for use in embodiments of the invention. The lens element 210 of FIGS. 7A-7E has an internal surface 210*b* facing a light source 110 and an external surface 210*a*. The internal surface 210*b* comprises a first curved surface 211*b* in the form of a first outwardly bulging surface and a second curved surface 212*b* in the form of a second outwardly bulging surface. The first curved surface 211*b* is connected to the second curved surface 212*b* through an internal connecting surface or line 213*b* comprising a saddle point or discontinuity. The external surface 210*a* comprises a first curved surface 211*a* in the form of a first outwardly bulging surface and a second curved surface 212 in the form of a second outwardly bulging surface. The first curved surface 211*a* is connected to the second curved surface 212*a* through an external connecting surface or line 213*a* comprising a saddle point or discontinuity. The second support 200 is movable relative to said first support 100 such that the light source 110 can be in at least a first position P1 facing the first curved surfaces 211*a*, 211*b* or in at least a second position P2 facing the second curved surfaces 212*a*, 212*b*. The lens element 210 has a circumferential edge 218 in contact with the first support 100, and the internal connecting surface or line 213*b* is at a distance of the first support 100. In other words the lens element 210 moves in contact with the first support 100, and the distance between the internal connecting surface or line 213*b* and the first support allows the light source to pass underneath the connecting surface or line 213*b* when the second support 200 is moved from a first position where the light source 110 faces the first curved surfaces 211*a*, 211*b* to a second position where the light source 110 faces the second curved surfaces 212*a*, 212*b*. As is best visible in FIG. 7B, the external connecting surface

213*a* comprises a "line" portion in a central part, and two "surface" portions on either side of the "line" portion. Optionally, the external connecting surface 213*b* may be covered partially with a reflective coating, e.g. the hatched "surface" portions in the top view of FIG. 7B may be provided with a reflective coating.

Figure 7A:
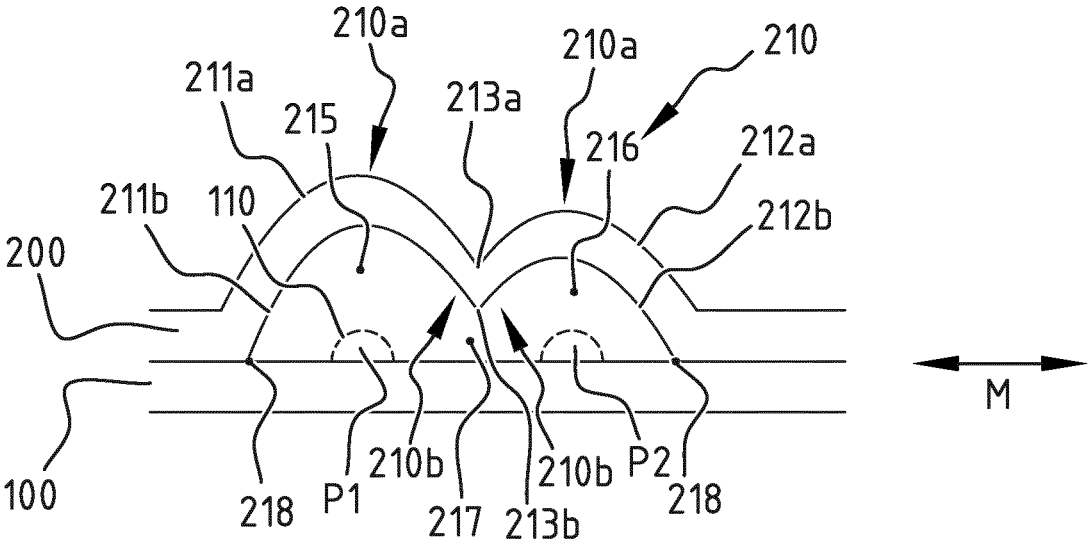
FIG. 7A shows a schematic cross-sectional view of another exemplary embodiment of a lens element.
Figure 7B:
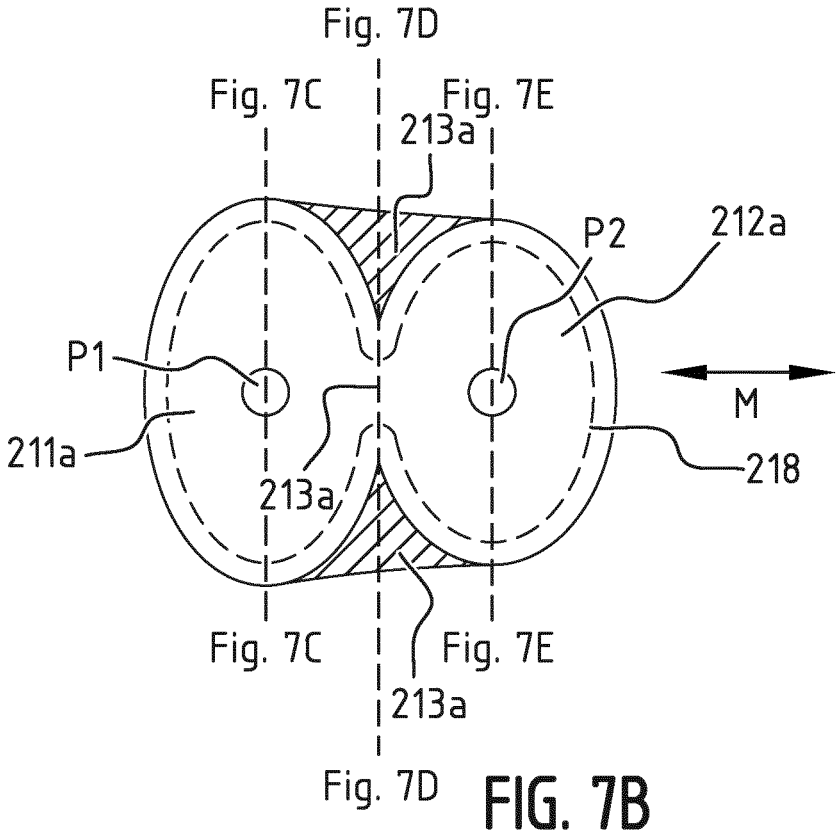
FIG. 7B shows a schematic top view of the lens element of FIG. 7A.
Figure 7C:
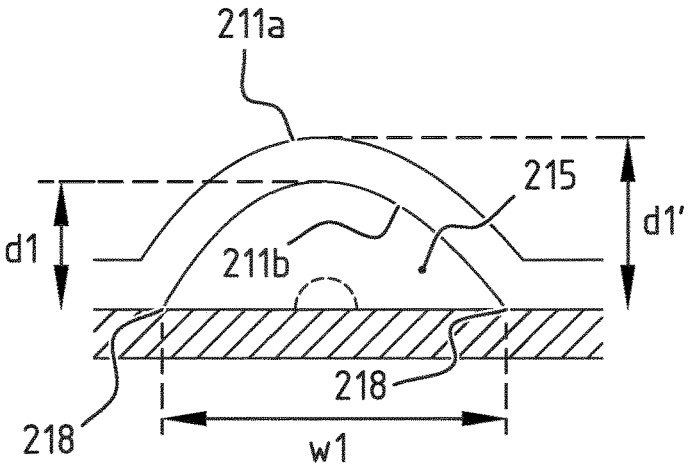
FIGS. 7C, 7D, 7E are schematic cross-sectional views of the lens element along lines 7C-7C, 7D-7D, 7E-7E shown in FIG. 7B.
Figure 7D:
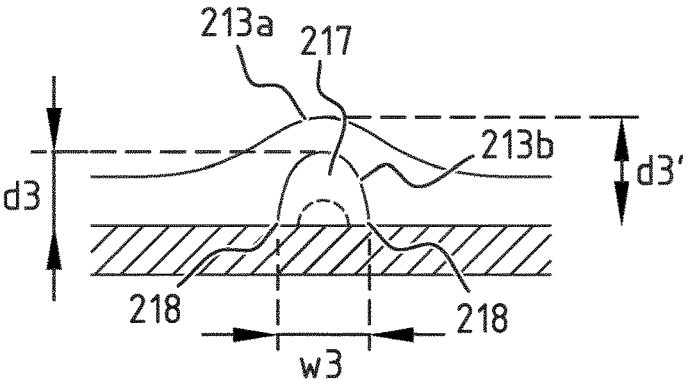
Figure 7E:
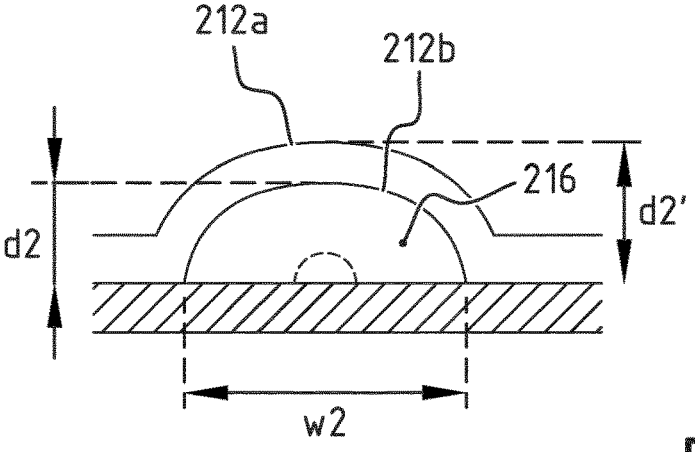

The first outwardly bulging surface 211*b* and the first support 100 delimit a first internal cavity 215, the second outwardly bulging surface 212*b* and the first support 100 delimit a second internal cavity 216, and the internal connecting surface or line 213*b* and the first support 100 delimit a connecting passage 217 between the first and second internal cavity. FIG. 7C shows a cross section along line 7C-7C in FIG. 7B, and illustrates that the first internal cavity 215 has a first maximal width w1, said first maximal width extending in a direction perpendicular on the moving direction M and measured in an upper plane of the first support 100. Similarly, FIG. 7D shows a cross section along line 7D-7D in FIG. 7B, and illustrates that the second internal cavity 216 has a second maximal width w2. FIG. 7E shows a cross section along line 7E-7E in FIG. 7B, and illustrates that the connecting passage 217 has a third minimal width w3. The first maximal width w1 and the second maximal width w2 are preferably larger than the third width w3. Also, the first maximal width w1 and the second maximal width w2 may be different. The first outwardly bulging surface 211*b* is at a first maximal distance d1 of the first support 100, the second outwardly bulging surface 212*b* is at a second maximal distance d2 of the first support 100, and the internal saddle point or discontinuity is at a third minimal distance d3 of the first support 100. The third minimal distance d3 may be lower than said first and second maximal distance d1, d2. Preferably, the first and second maximal distance d1, d2 are different. Similarly, the first outwardly bulging surface 211*a* is at a first maximal distance d1' of the first support 100, the second outwardly bulging surface 212*a* is at a second maximal distance d2' of the first support 100, and the external saddle point or discontinuity is at a third minimal distance d3' of the first support 100. The third minimal distance d3' may be lower than the first and second maximal distance d1', d2'. Preferably, the first and second maximal distance d1', d2' are different.

Figure 8:
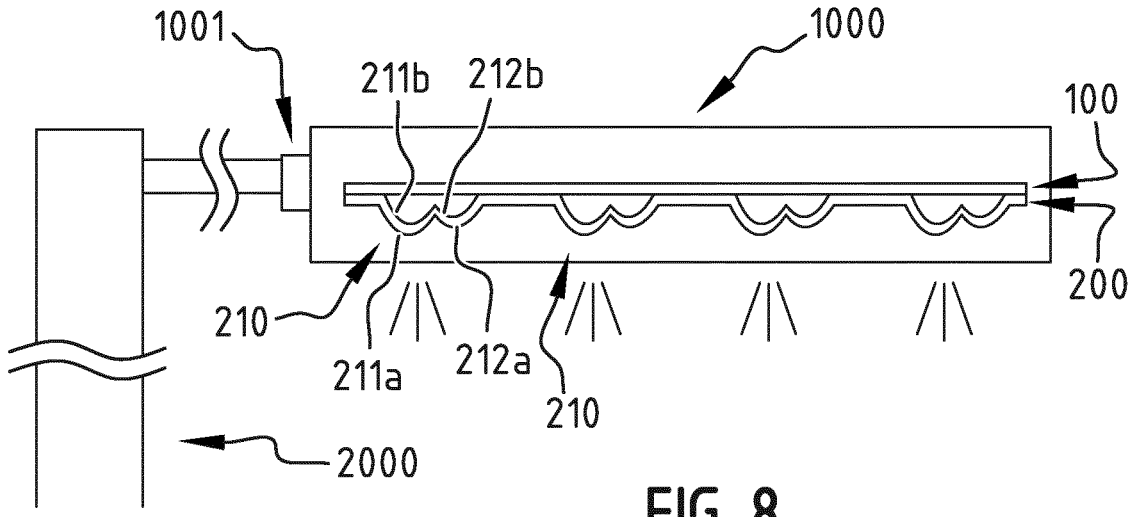
FIG. 8 illustrates schematically an exemplary embodiment of a luminaire head connected to a support pole.

FIG. 8 illustrates an embodiment of a luminaire head 1000 attached to a support pole 3000. The luminaire head 1000 has a fixation end 1001 configured for being attached to the pole 3000. Preferably, the largest "bell" of a "double bulged" lens element 210 is located closest to the support pole 3000. In other words, when the first maximal distance d1 and/or d1' is larger than the second maximal distance d2 and/or d2", then preferably, the lens element 210 is arranged such that the first curved surface 211*a*, 211*b* is closer to the fixation end 1001 of the luminaire head 1000 than the second curved surface 212*a*, 212*b*. However, in other embodiments the arrangement may be different. The embodiment of FIG. 8 is especially advantageous when one or more reflector elements are integrated in the lens elements as in the exemplary embodiment of FIG. 9. It is noted that the "double bulged" lens element may also be oriented in a street direction or vehicle driving direction, i.e. turned over 90° compared to the position shown in FIG. 8. Also, it is possible to provide a "quadruple bulged" lens element with four "bells" e.g. arranged in 2×2 array, and such that an associated light source can be located opposite any one of the four "bells".

Figure 9:
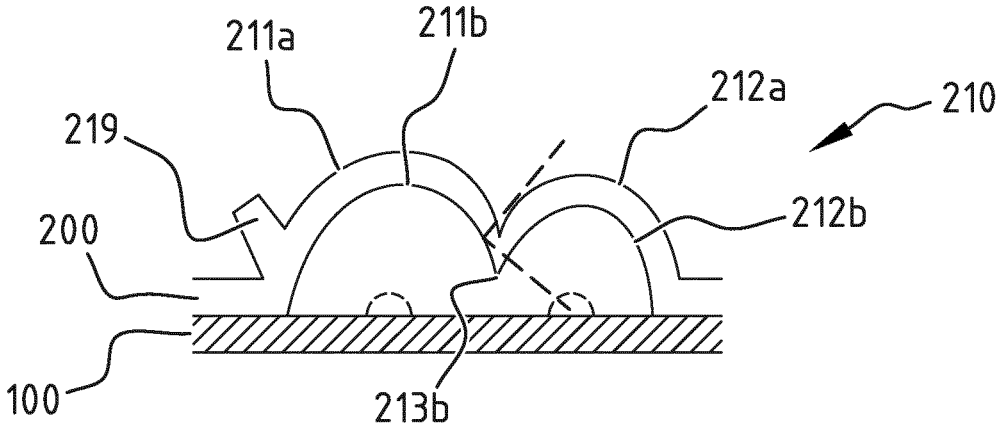
FIGS. 9, 10, and 11 illustrate schematic cross-sectional views of other exemplary embodiments of a lens element.

The embodiment of FIG. 9 is similar to the embodiment of FIGS. 7A-7E with this difference that the lens element 210 further comprises a first reflective surface 219 located near a first edge of the first curved surfaces 211*a*, 211*b*, said first edge being in the mounted position closer to the support pole than a second opposite edge of the first curved surface 211*a*, 211*b*. Optionally a second reflective surface 219' may be located near the second edge of the first curved surfaces 211*a*, 211*b*, wherein the second edge is an edge near the connecting surface or line 213*a*, 213*b*. Additionally or alternatively, a reflective element (not shown) may be provided to the light source 110.

Figure 10:
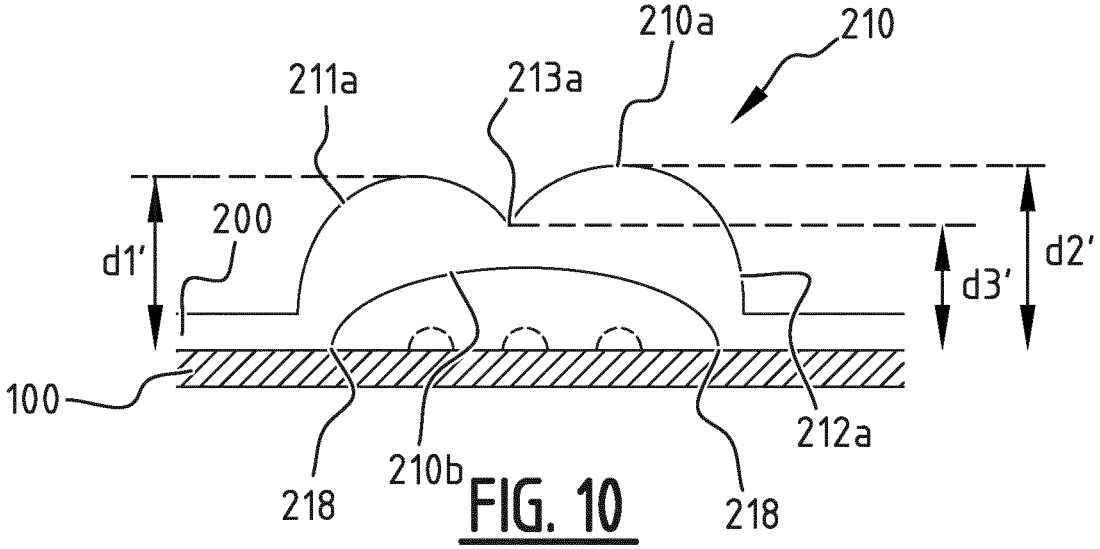

FIG. 10 illustrates another embodiment of a lens element 210. The internal surface 210*b* is a continuous surface without discontinuity of saddle point. However, the external surface 210*a* comprises a first curved surface 211*a* in the form of a first outwardly bulging surface and a second curved surface 212*a* in the form of a second outwardly bulging surface. The first curved surface 211*a* is connected to the second curved surface 212*a* through an external connecting surface or line 213*a* comprising a saddle point or discontinuity. Other preferred features of the external surface 210*a* may be the same or similar as those described above for the embodiment of FIGS. 7A-7E.

Figure 11:
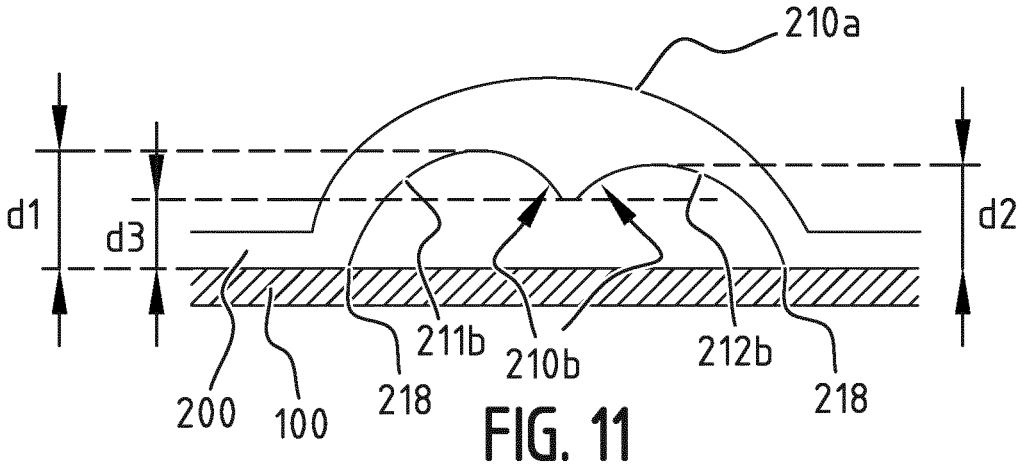

FIG. 11 illustrates yet another embodiment of a lens element 210. The external surface 210*a* is a continuous surface without discontinuity of saddle point. However, the internal surface 210*b* comprises a first curved surface 211*b* in the form of a first outwardly bulging surface and a second curved surface 212*b* in the form of a second outwardly bulging surface. The first curved surface 211*b* is connected to the second curved surface 212*b* through an internal connecting surface or line 213*b* comprising a saddle point or discontinuity. Other preferred features of the internal surface 210*b* may be the same or similar as those described above for the embodiment of FIGS. 7A-7E.

Figure 12A:
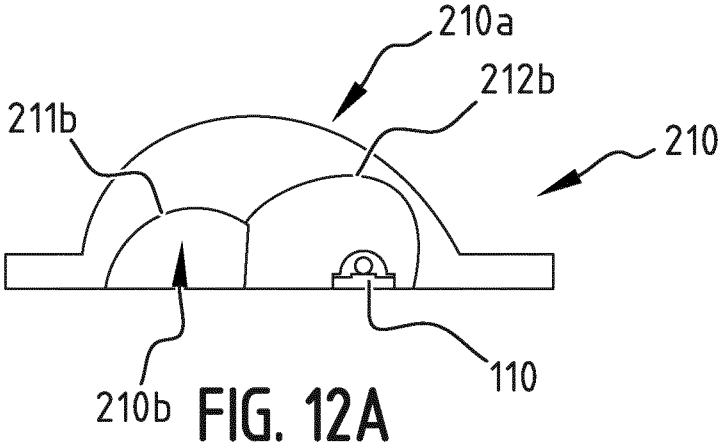
FIGS. 12A and 12B illustrate a sectional view and a perspective view of another exemplary embodiment of a lens element.
Figure 12B:
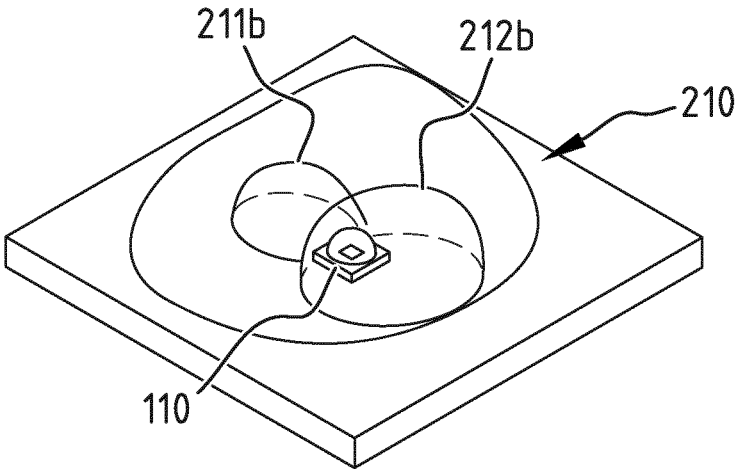
Figure 13A:
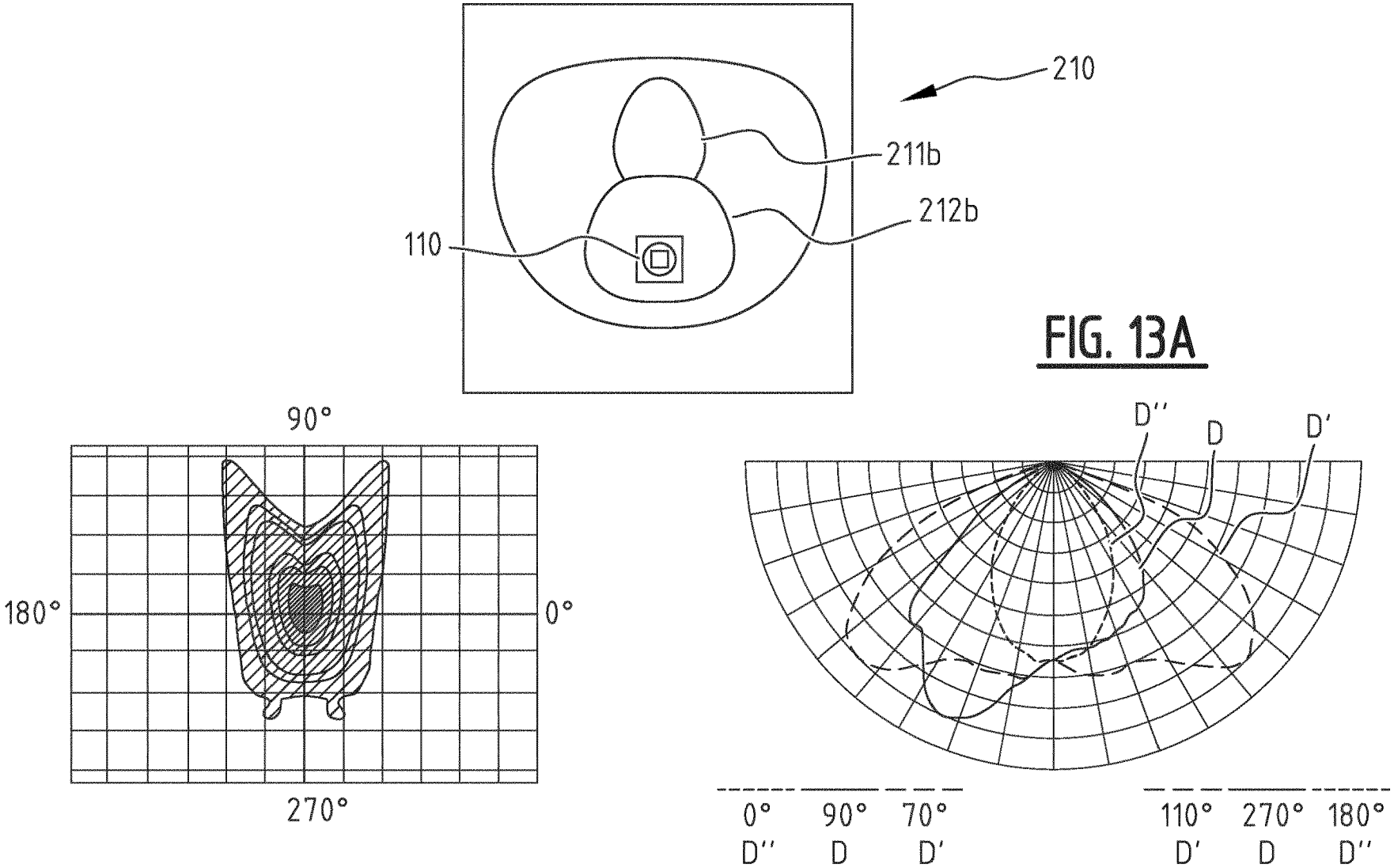
Figure 13B:
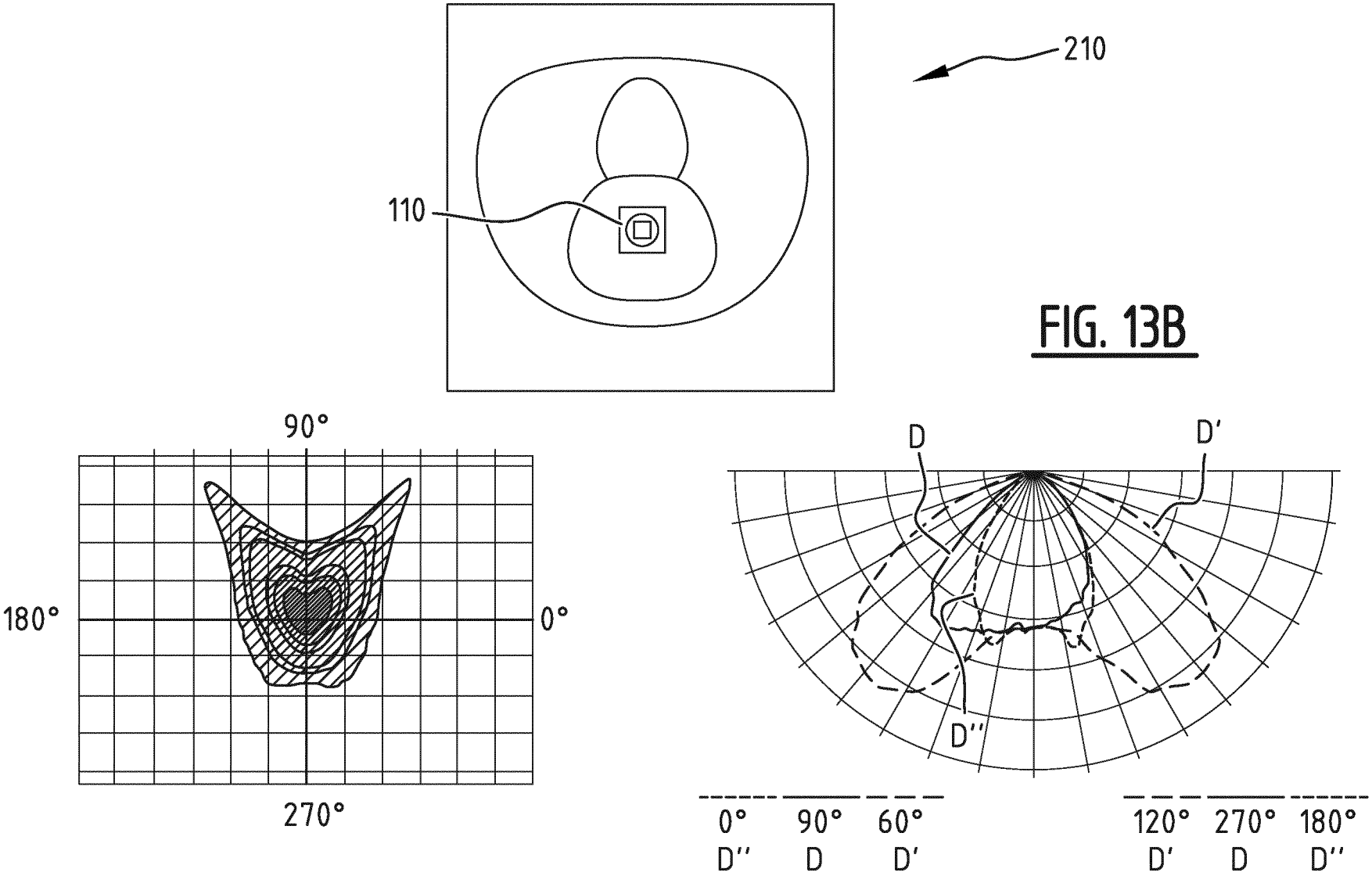
Figure 13C:
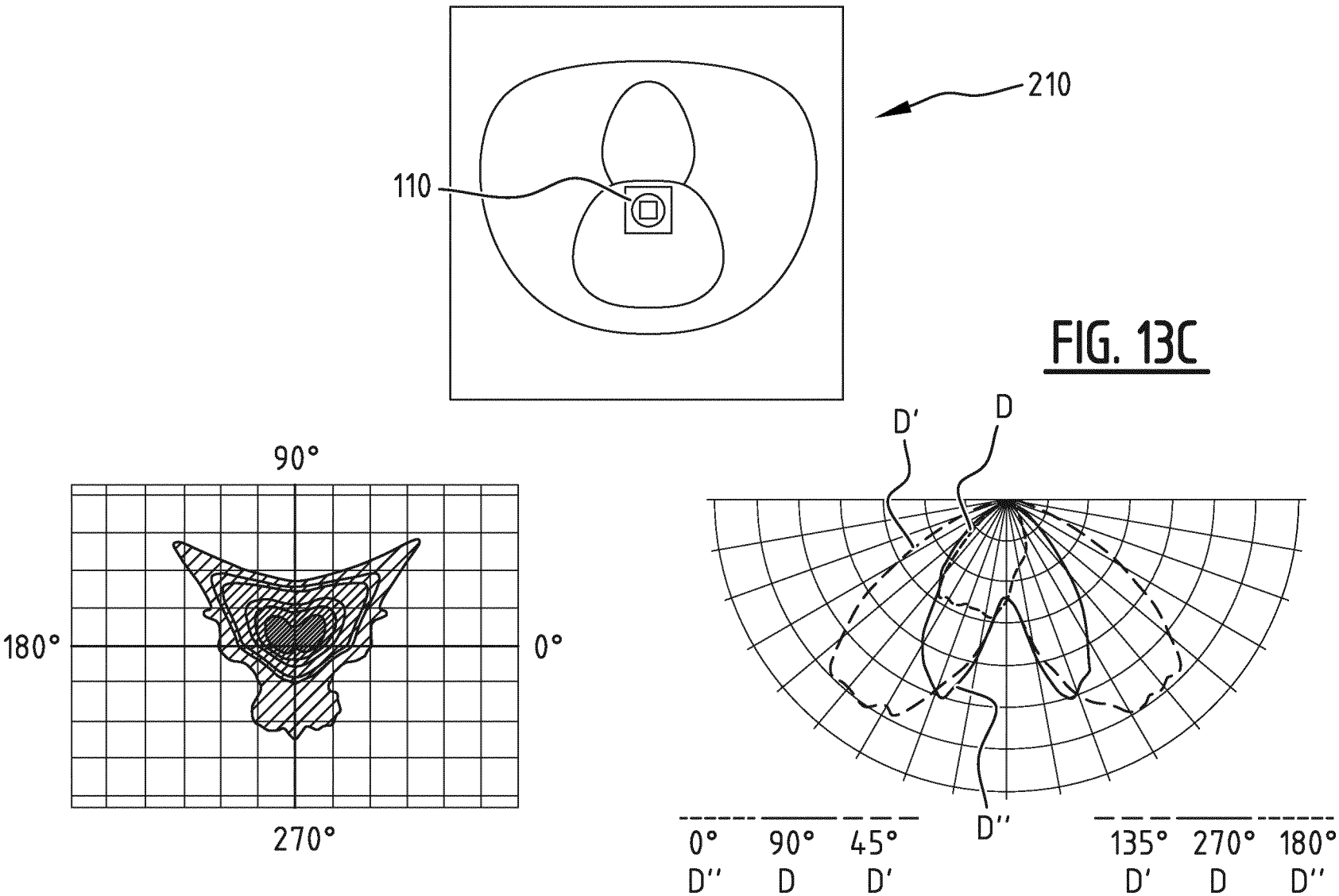

FIGS. 12A and 12B illustrate a sectional view and a perspective view of another exemplary embodiment of a lens element which is similar to the lens element 210 of FIG. 11, and reference is made to the description above for FIG. 11. FIGS. 13A-E illustrate light distributions for the lens element of FIGS. 12A and 12B in various positions of a light source relative to the lens element. On the polar diagram on the right of each of the FIGS. 13A-E, D shows the light distribution at 90°/270° (i.e. in a plane through a transversal axis of the lens element and perpendicular on the first support)). D' shows the light distribution in a plane at angle (i.e. in a plane making an angle of e.g. 70°/110° (FIG. 13A) with a longitudinal axis of the lens element, perpendicular on the first support). This plane corresponds with a plane where the intensity is maximal. The angle of this plane varies depending on the position of the light source, as illustrated in FIGS. 13A-C. D" shows the light distribution at 0°/180° (i.e. in a plane through the longitudinal axis, perpendicular on the first support). The diagram on the left of FIGS. 13A-E illustrates the light distribution in a plane parallel to the street plane. As can be seen in the diagram on the left of FIGS. 13A-E, the light beam is symmetrical with respect to the C90/C270 plane which is oriented perpendicular to the street direction. FIGS. 13A-C illustrate the light distribution when the light source 110 is opposite the curved surface 212*b* generating a butterfly shaped light pattern in the diagram on the left, wherein the dimensions and shape can be changed depending on the position of the light source 110 relative to the curved surface 212*b*. FIGS. 13D-E illustrate the light distribution when the light source 110 is opposite the curved surface 211*b* generating a more compressed "butterfly" shaped light pattern in the diagram on the left, wherein the dimensions and shape can be changed depending on the position relative to the curved surface 211*b*.

Figure 14:
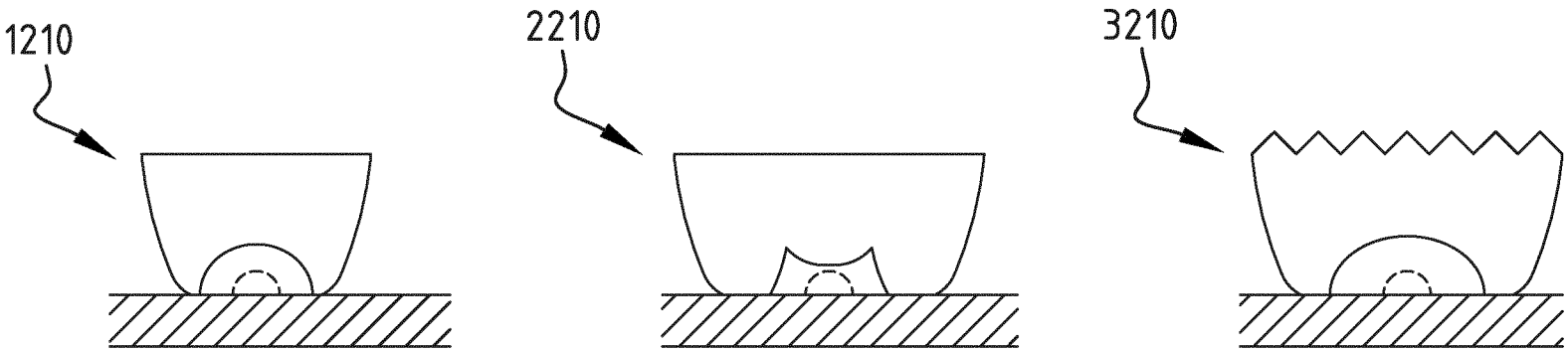
FIG. 14 illustrates a sectional view of three further exemplary embodiments of a lens element.

As explained above, a lens element may include any transmissive optical element that focuses or disperses light by means of refraction. It may also include any one of the following: a reflective portion, a backlight portion, a collimator portion, a diffusor portion. FIG. 14 illustrates three exemplary embodiments of lens elements 1210, 2210, 3210 with a lens portion with a concave or convex surface facing a light source, and a collimator portion integrally formed with said lens portion. In the figures on the left and on the right, the surface facing the light source is a concave surface, and in the figure in the middle, the surface facing the light source is a convex surface. The collimator portion is configured for collimating light transmitted through said surface. The light is emitted through the collimator portion through an external surface of the collimator portion. As shown in the figure on the right, the external surface may be provided with a large plurality of small flat and/or curved facets or protrusions.

In the exemplary embodiment of FIG. 3C, there are a first 210 and a second 210' lens element corresponding both to a light source 110 of the plurality of light sources 110. The first and the second lens elements 210, 210' have opposite shape and thickness variation along the movement direction. Moving the plurality of light sources 110 such that the plurality of light sources 110 corresponds to the first 210 or the second 210' lens element may modify the lighting pattern obtained from the luminaire head 1000 such that the overall directionality of the light distribution is reversed. In the illustrated embodiment of FIG. 3C, the controlling means 400 may be configured to control the moving means 300 such that the second support 200 is moved over a distance greater than the sum of the separation distance between the first and second lens elements 210, 210' and the internal dimension D1 or D2 of the first or second lens element 210, 210'. In such a way, the light source 110 may correspond to the first or the second lens element 210, 210'.

Moving the lens plate 230 to position the plurality of lens elements 210 in a plurality of positions will result in a plurality of lighting patterns on a surface, said plurality of lighting patterns having a plurality of different illuminated surface areas. The skilled person will understand that various designs can be implemented to reach a greater variety of lighting patterns.

Figure 4A:
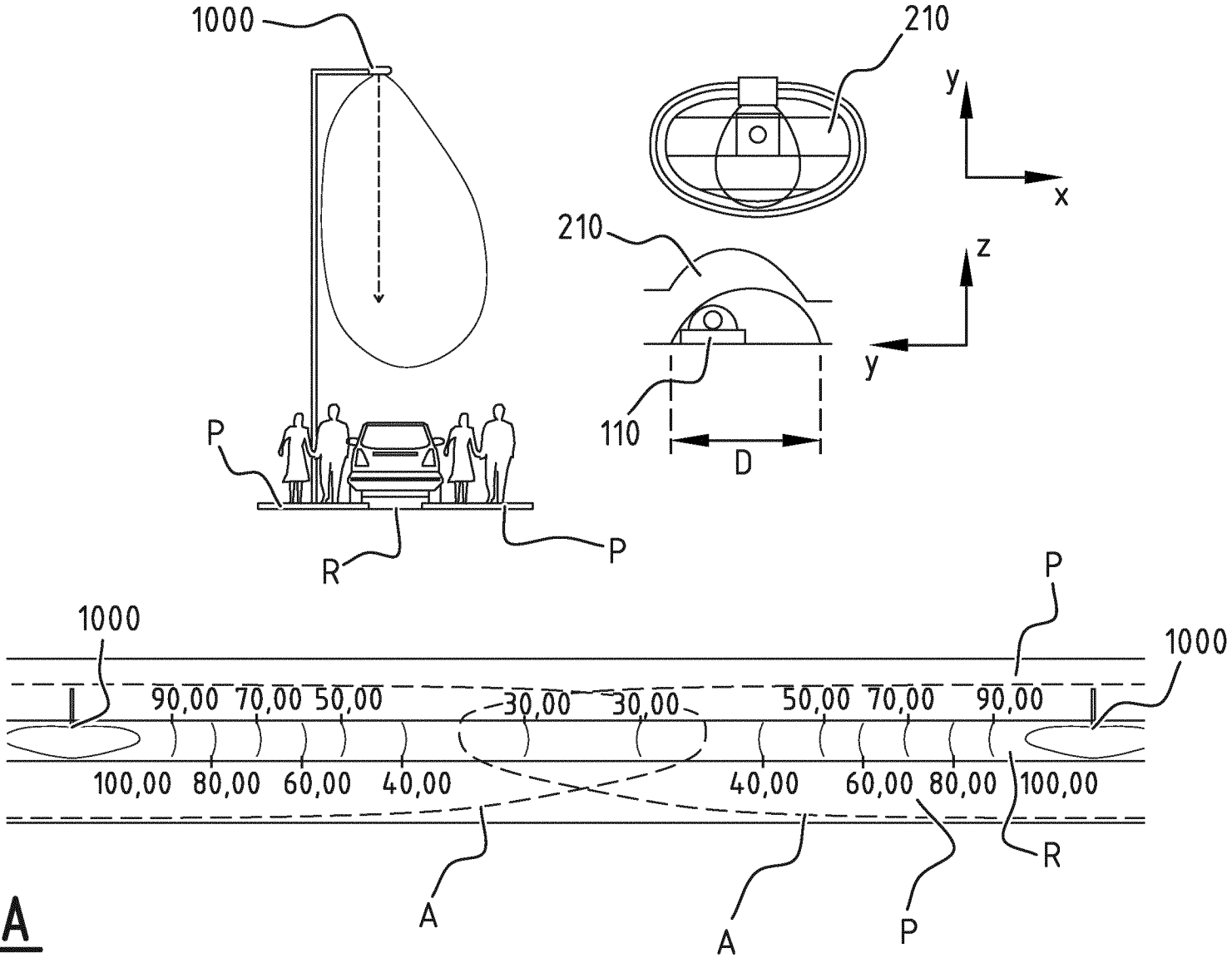
FIGS. 4A-4B illustrate exemplary embodiments of light distributions of a luminaire head according to the invention.
Figure 4B:
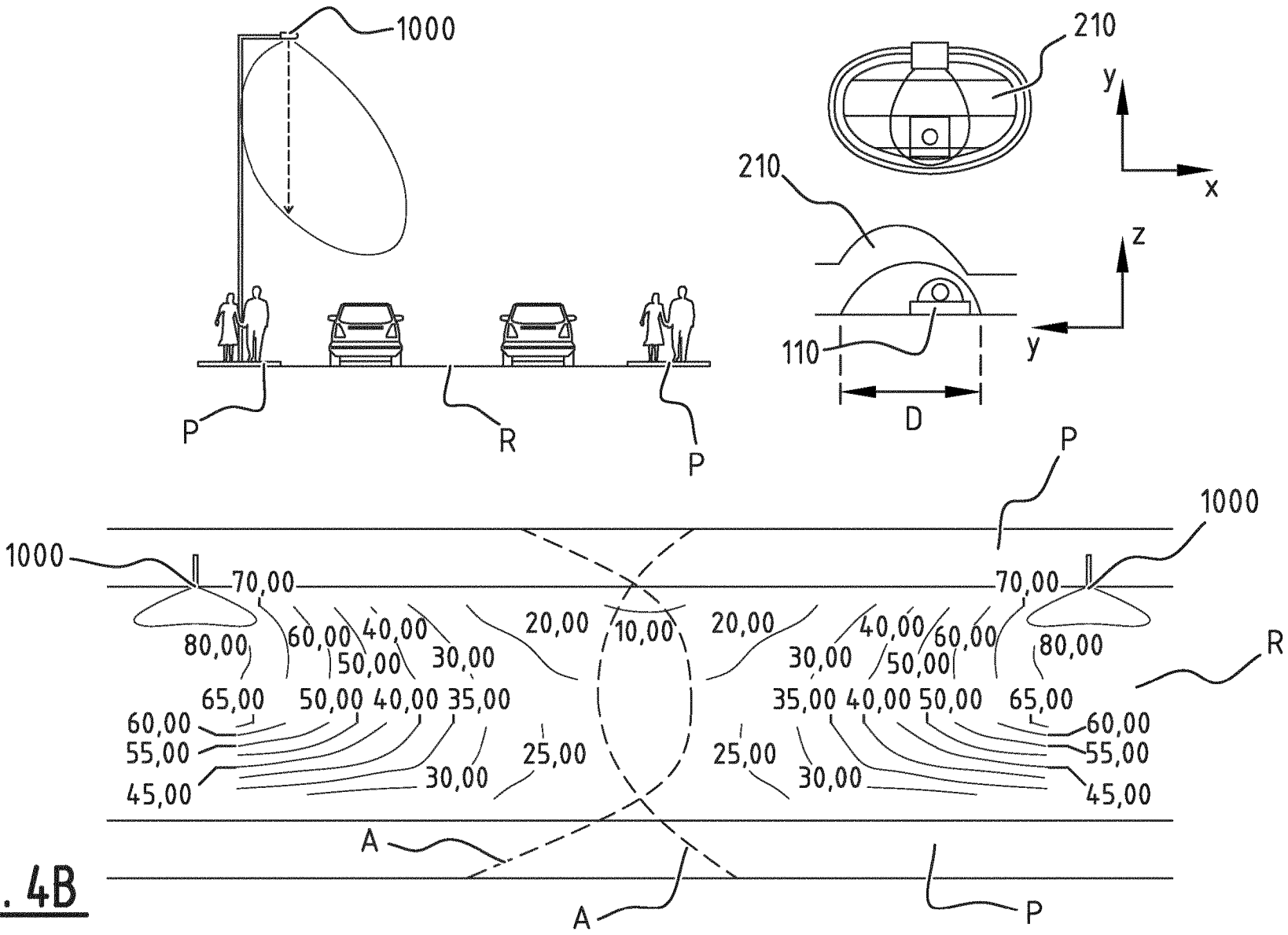

FIGS. 4A-4B illustrate exemplary embodiments of light distributions of a luminaire head according to the present invention. The luminaire head comprises a first support 100 comprising a plurality of light sources 110, in the illustrated embodiments LEDs, and a second support 200 comprising a plurality of lens elements 210 associated with the plurality of light sources 110.

A lens element 210 of the plurality of lens elements 210 extends over the corresponding light source 110 of the plurality of light sources, e.g. in the illustrated embodiments LEDs. In the exemplary embodiments of FIGS. 4A-4B, the lens element 210 has a varying profile in shape and thickness along the direction of movement of the lens element 210, the y-direction in the illustrated embodiments. The lens element 210 may have a movement between a first extreme position and a second extreme position, wherein the distance between the first and the second extreme position is below 90% of the internal dimension D of the lens element 210. The luminaire head is placed at a height H to illuminate a path of width W. A lighting pattern corresponds with an illuminated surface area A on a surface, resulting from the light distribution of the luminaire head 1000. The surface corresponds with a road R in between two pedestrian paths P in the illustrated embodiments of FIGS. 4A-4B.

Additionally one may consider the intensity of the lighting pattern of two luminaire heads having a luminous flux of 6000 lm each and separated by a distance of 32 m as represented from a top view of a single-lane road or a double-lane road, as illustrated in FIG. 4A and FIG. 4B, respectively. The lighting pattern intensity is represented as illuminance level curves in lux as projected on illuminated surface areas A such that the maximum illuminance is located substantially vertically below the corresponding luminaire head 1000. One may notice a minimum in illuminance at the middle point between the two illustrated luminaire heads 1000. The minimum in illuminance is located in an overlapping area of the illuminated surface areas A corresponding to the two separated luminaire heads.

In the exemplary embodiment of FIG. 4A, the lens element 210 is in position such that the light source 110 is at the first extreme position of the lens element 210. The resulting light pattern of a luminaire head 1000 positioned at a height of 8 m and facing downwards with light sources 110 and lens elements 210 may be as illustrated. It may be noticed that the emitted light is most intense substantially at the vertical of the luminaire head and has a limited dispersion forward and backward.

In the exemplary embodiment of FIG. 4B, the lens element 210 is in a position such that the light source 110 is at the second extreme position of the lens element 210. The resulting light pattern of a luminaire head 1000 positioned at a height of 8 m and facing downwards with light sources 110 and lens elements 210 may be as illustrated. It may be noticed that the emitted light is more intense in a forward direction than in a backward direction, and that it is most intense forward of the luminaire head 1000.

Moving the plurality of lens elements 210 along the direction of movement at intermediate positions between the first and the second extreme position may allow the resulting light distribution to be adapted more easily to different sites without having to mount different light components. Additionally, the adaptability is made easier by the common movement of the plurality of lens elements 210 rather than on an individual basis. It is to be noted that the ratio W/H representative of the position of the luminaire head 1000 may be varied greatly by moving the plurality of lens elements 210 between the two extreme positions; making the luminaire head 1000 suitable for a large number of sites.

The skilled person will understand that the hereinabove described embodiments according to the present invention can be implemented according to different designs to allow for a greater variety of lighting patterns, e.g. by using two lens elements per light source or a lens element with different profile parts such as described in the embodiments of FIGS. 3A-3C.

Figure 5:
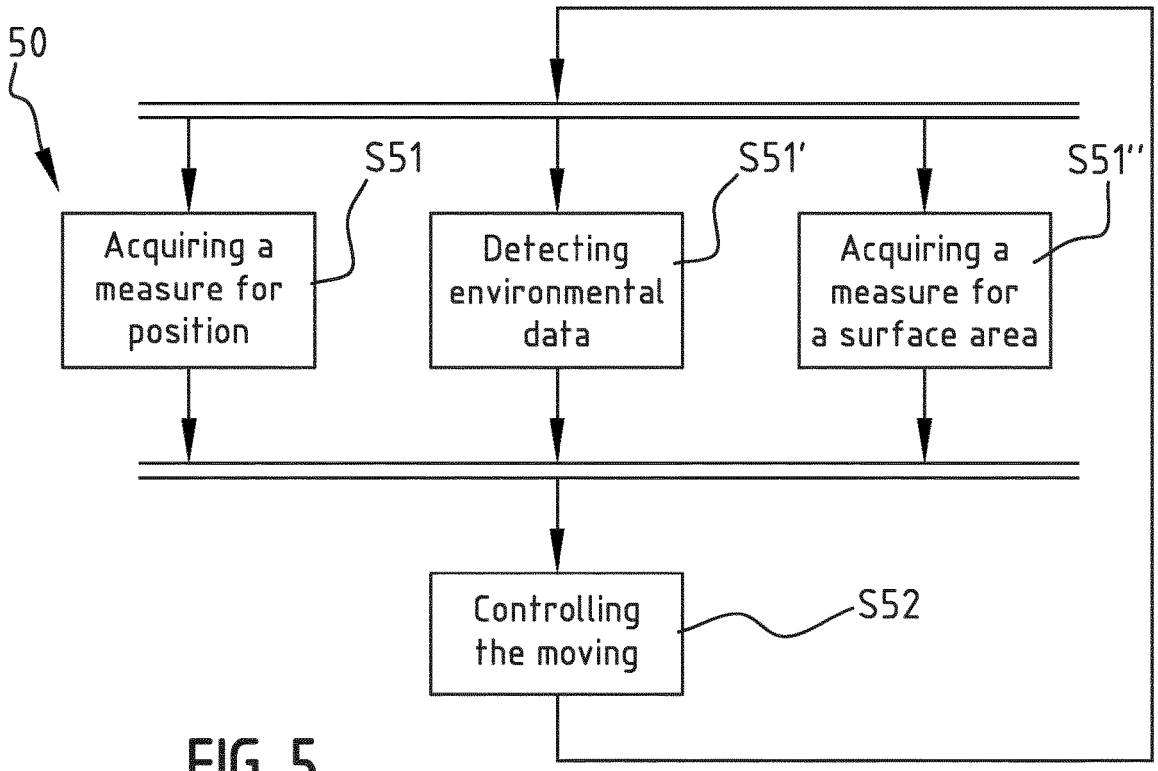
FIG. 5 illustrates schematically an exemplary embodiment of a method for controlling a light pattern according to the invention.

FIG. 5 illustrates schematically an exemplary embodiment of a method for controlling a light distribution, preferably a light distribution of a luminaire head, according to the invention. The method 50 is for controlling a light distribution comprising moving of a second support 200 comprising a plurality of lens elements 210 with respect to a first support 100 comprising a plurality of light sources 110 such that a position of the plurality of lens elements 210 geometrically projected on a surface of the first support 100 is changed, resulting in a changed light distribution. The method 50 comprises optionally a first step of acquiring a measure S51 of a position of the second support 200 relative to the first support 100, and a second step of moving and controlling the moving S52 of the second support 200 with respect to the first support 100, to finally obtain a changed light distribution.

The luminaire head 1000 comprises a moving means 300. It may also comprise a sensing means. The sensing means may allow acquiring a measure S51 for a position of the second support 200 relative to the first support 100. This first measure is associated to a first light distribution. To obtain a new light distribution, the second support 200 needs to be moved relative to the first support 100 such that the plurality of light sources 110 has their emitted light being dispersed in a different manner by the corresponding plurality of lens elements 210.

Moving the second support 200 may be controlled S52 such that the movement of the second support 200 is substantially parallel with respect to the first support 100. This way, the moving will result in a change of the light distribution according to the change in the profile of the plurality of lens elements 210. Furthermore, the controlling S52 may be done in such a way that a plurality of moving positions are defined corresponding to a plurality of lighting patterns and the second support 200 movement is controlled to be moved to these different positions. Acquiring the measure S51 for the position of the second support 200 may allow controlling the moving S52 in function of the acquired measure. It is to be noted that measures of positions may be associated to respective lighting patterns. In another embodiment, the moving may comprise a rotational movement.

Using one lens element 210 per light source 110, wherein each lens element 210 has a length seen in a movement direction of the moving, may be supported by controlling the moving S52 such that the moving of the second support 200 is carried out over a distance below 90% of the length of the lens element 210, preferably below 50% of the length of the lens element 210. Moving the lens element 210 along the varying profile will allow obtaining different lighting patterns at different positions of the light source 110 under the same lens element 210. In another embodiment, the light source 110 may be controlled to be moved between different lens elements 210 having different varying profiles. In a further embodiment the moving is arranged such that the first and the second support 100, 200 are in contact.

Additional sensors (not shown) may also be provided to the luminaire head 1000 such as an environment sensing means or a pattern sensing means. The environment sensing means and/or the pattern sensing means may be provided to the luminaire head 1000 or may be added in a later phase of the luminaire head installation 100. The step S51' of detecting environmental data, e.g. luminosity, sound, dynamic object, of the immediate surroundings of the luminaire head 1000 may be achieved with the environment sensing means.

Controlling the moving means S52 in function of the detected environmental data may allow changing the lighting pattern of the luminaire head 1000 in accordance with the detected environmental data in a more dynamic manner, e.g. compensating luminosity depending on weather, changing to a lighting pattern more adapted for a specific passing object, etc. The step S51" of acquiring a measure of an illuminated surface area associated with a corresponding position of the plurality of lens elements may be achieved with the pattern sensing means. Then, controlling the moving means S52 in function of the acquired measure will enable a more adapted light distribution to be achieved relative to the current environment of the luminaire head. Alternatively, acquiring a measure of the surface area S51" associated with the lighting pattern will enable the correlation between a position of the plurality of lens elements and the resulting lighting pattern based on the acquired measure of the position S51 of the second support 200 compared to the first support 100.

The step S52 of controlling the movement of the second support 200 with respect to the first support 100 may be optionally integrated in a feedback loop wherein the position, environmental data, and/or surface area corresponding to the lighting pattern is continuously ascertained during the movement. Such exemplary embodiment of the method may enable dynamic changes in the light distribution and more precise positioning of the plurality of lens elements 210 with respect to the plurality of light sources 110.

The invention claimed is:

1. A luminaire head comprising:

a first support comprising a plurality of light sources;

a second support comprising a plurality of lens elements associated with the plurality of light sources, said plurality of lens elements being mounted such that each of the plurality of light sources is covered by a lens element, wherein a lens element of the plurality of lens elements has an internal surface facing a light source of the plurality of light sources and an external surface; and a moving means configured to move the second support with respect to the first support, such that a position of the plurality of lens elements geometrically projected on a surface of the first support is changed, wherein the lens element of the plurality of lens elements has a varying profile seen in a movement direction of the moving means, and wherein the lens element of the plurality of lens elements includes a collimator portion or a diffusor portion.

2. The luminaire head of claim 1, further comprising a controlling means configured to control the moving means, such that the movement of the second support with respect to the first support is controlled.

3. The luminaire head of claim 1, wherein the first support is mounted substantially parallel to the second support, and wherein the moving means is configured to move the second support substantially parallel to the first support.

4. The luminaire head of claim 1, wherein the external surface comprises a first outwardly bulging surface, a second outwardly bulging surface, and an external connecting surface or line connecting said first and second outwardly bulging surfaces.

5. The luminaire head of claim 1, wherein the internal surface comprises a first outwardly bulging surface, a second outwardly bulging surface, and an internal connecting surface or line connecting said first and second outwardly bulging surfaces.

6. The luminaire head of claim 5, wherein the first outwardly bulging surface and the first support delimit a first internal cavity, wherein the second outwardly bulging surface and the first support delimit a second internal cavity, and wherein the internal connecting surface or line and the first support delimit a connecting passage between the first and second internal cavity.

7. The luminaire head of claim 6, wherein a first maximal width of the first internal cavity and a second maximal width of the second internal cavity are bigger than a third minimal width of the connecting passage between the first and second internal cavity, and wherein said first maximal width, said second maximal width, and said third minimal width extend in a direction perpendicular to the moving direction.

8. The luminaire head of claim 1, wherein the second support is arranged to move in contact with the first support.

9. The luminaire head of claim 1, wherein the second support comprises a frame and one or more lens plates integrating the plurality of lens elements, and wherein the one or more lens plates are carried by the frame.

10. The luminaire head of claim 2, further comprising a sensing means configured to acquire a measure for a position of the second support relative to the first support, wherein the controlling means is configured to control the moving means in function of the acquired measure.

11. The luminaire head of claim 2, further comprising an environment sensing means configured to detect environmental data, wherein the controlling means is configured to control the moving means in function of the detected environmental data.

12. The luminaire head of claim 2, further comprising a pattern sensing means configured to acquire a measure for a lighting pattern produced by the luminaire head, wherein the controlling means is configured to control the moving means in function of the acquired measure.

13. The luminaire head of claim 1, further comprising: a driver configured to drive the plurality of light sources and, optionally, a dimmer configured to control the driver to drive one or more of the plurality of light sources at a dimmed intensity.

14. The luminaire head of claim 1, wherein the moving means comprises a linear actuator, preferably a stepper motor.

15. The luminaire head of claim 1, wherein the lens element of the plurality of lens elements includes a collimator portion configured for reducing a width of a light beam emitted from the collimator portion.

16. A luminaire head comprising:

a first support comprising a plurality of light sources;

a second support comprising a plurality of lens elements associated with the plurality of light sources; and a moving means configured to move the second support with respect to the first support, such that a position of the plurality of lens elements geometrically projected on a surface of the first support is changed, wherein a lens element of the plurality of lens elements has an internal surface facing a light source of the plurality of light sources and an external surface, wherein at least one of said internal surface and said external surface comprises a first curved surface and a second curved surface, said first curved surface being connected to said second curved surface through a connecting surface or line comprising a saddle point or discontinuity, wherein said second support is movable relative to said first support to position the light source from at least a first position facing the first curved surface to at least a second position facing the second curved surface, wherein the first curved surface is at a first maximal distance of the first support, the second curved surface is at a second maximal distance of the first support, and the saddle point or discontinuity is at a third minimal distance of the first support, said third minimal distance being lower than said first and second maximal distance, and wherein preferably said first and second maximal distance are different.

17. The luminaire head of claim 16, wherein the lens element further comprises at least one reflective element configured to reflect a portion of the light emitted by the light source, wherein preferably said at least one reflective element comprises a first reflective surface located at a first edge of the first curved surface and a second reflective surface located at a second edge of the first curved surface, and wherein the second edge is an edge near the connecting surface or line and the first edge is opposite the second edge, away from the connecting surface or line.

18. A luminaire head control system comprising at least one luminaire head, wherein the at least one luminaire head comprises:

a first support comprising a plurality of light sources;

a second support comprising a plurality of lens elements associated with the plurality of light sources;

a moving means configured to move the second support with respect to the first support, such that a position of the plurality of lens elements geometrically projected on a surface of the first support is changed; and a controlling means configured to control the moving means, such that the movement of the second support with respect to the first support is controlled, wherein the controlling means is further configured to control the moving means based on sensed data acquired from sensing means of nearby luminaire heads of said at least one luminaire head, and wherein the sensed data includes data from a pattern sensing means and/or data from an environment sensing means.

19. The luminaire head control system of claim 18, further comprising a remote device, wherein the remote device is configured to send lighting data to the at least one luminaire head, and wherein the controlling means of the at least one luminaire head is further configured for controlling the moving means based on the lighting data received by the at least one luminaire head.

20. The luminaire head control system of claim 19, wherein the at least one luminaire head further comprises a sensing means configured to acquire a measure for a position of the second support relative to the first support, and wherein the controlling means is configured to control the moving means in function of the acquired measure.

21. The luminaire head control system of claim 18, further comprising a communication interface.

* * * * *